US009617685B2

(12) United States Patent
Clark et al.

(10) Patent No.: US 9,617,685 B2
(45) **Date of Patent: *Apr. 11, 2017**

(54) PROCESS FOR MAKING PAPER AND NONWOVEN ARTICLES COMPRISING SYNTHETIC MICROFIBER BINDERS

(71) Applicant: Eastman Chemical Company, Kingsport, TN (US)

(72) Inventors: Mark Dwight Clark, Kingsport, TN (US); Keh Dema, Kingsport, TN (US); Sungkyun Sohn, Kingsport, TN (US); Ernest Phillip Smith, Blountville, TN (US); Chris Delbert Anderson, Perrysburg, OH (US); Charles Stuart Everett, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/249,868

(22) Filed: Apr. 10, 2014

(65) Prior Publication Data

US 2014/0311695 A1 Oct. 23, 2014

Related U.S. Application Data

(60) Provisional application No. 61/813,774, filed on Apr. 19, 2013.

(51) Int. Cl.

| | |
|---|---|
| ***D21H 13/02*** | (2006.01) |
| ***D21H 13/06*** | (2006.01) |
| ***D21H 13/12*** | (2006.01) |
| ***D21H 13/36*** | (2006.01) |
| ***D21H 15/02*** | (2006.01) |
| ***D21H 13/20*** | (2006.01) |

(52) U.S. Cl.

CPC ..... *D21H 13/02* (2013.01); *D21H 13/06* (2013.01); *D21H 13/12* (2013.01); *D21H 13/20* (2013.01); *D21H 13/36* (2013.01); *D21H 15/02* (2013.01)

(58) Field of Classification Search

CPC ..... D21H 13/24; D21H 13/00; D21H 13/02; D21H 13/10; D21H 13/12; D21H 13/16; D21H 15/10; D04H 1/465; H01M 2/162; H01M 2/1626; D21F 11/00; D21F 11/006; D21F 11/008

USPC ..... 162/109, 141, 145, 146, 147, 149, 162/157.1–157.7 M, 158, 162, 164.1, 162/168.1, 181.1, 172, 175

See application file for complete search history.

(56) References Cited

U.S. PATENT DOCUMENTS

| | | | |
|---|---|---|---|
| 1,814,155 | A | 7/1931 | Haughey |
| 2,862,251 | A | 12/1958 | Kalwaites |
| 2,999,788 | A | 9/1961 | Morgan |
| 3,018,272 | A | 1/1962 | Griffing et al. |
| 3,033,822 | A | 5/1962 | Kibler et al. |
| 3,049,469 | A | 8/1962 | Davison et al. |
| 3,075,952 | A | 1/1963 | Coover et al. |
| 3,372,084 | A | 3/1968 | Hanns |
| 3,485,706 | A | 12/1969 | Evans |
| 3,528,947 | A | 9/1970 | Lappin et al. |
| 3,556,932 | A | 1/1971 | Coscia et al. |
| 3,592,796 | A | 7/1971 | Trapasso et al. |
| 3,772,076 | A | 11/1973 | Keim |
| 3,779,993 | A | 12/1973 | Kibler et al. |
| 3,783,093 | A | 1/1974 | Gallacher et al. |
| 3,803,210 | A | 4/1974 | Rod et al. |
| 3,833,457 | A | 9/1974 | Misumi et al. |
| 3,846,507 | A | 11/1974 | Thomm et al. |
| 3,985,502 | A | 10/1976 | Boorujy et al. |
| 3,998,740 | A | 12/1976 | Bost et al. |
| 4,008,344 | A | 2/1977 | Okamoto et al. |

(Continued)

FOREIGN PATENT DOCUMENTS

| | | |
|---|---|---|
| CA | 1290517 | 10/1991 |
| CN | 1824867 A | 8/2006 |

(Continued)

OTHER PUBLICATIONS

PCT International Search Report dated Feb. 4, 2008 for International Application No. PCT/US2007/001082.
U.S. Appl. No. 08/550,042, filed Oct. 30, 1995, Michael C. Cook.
PCT International Search Report dated Nov. 6, 2008 for International Application No. PCT/US2007/025661.
PCT International Search Report dated Jul. 26, 2007 for International Application No. PCT/US2007/001083.
Office Action with Mail Date of Mar. 30, 2009 for related U.S. Appl. No. 11/204,868.
Office Action with Mail Date of Mar. 26, 2009 for related U.S. Appl. No. 11/344,320.

(Continued)

*Primary Examiner* — Jose Fortuna
(74) *Attorney, Agent, or Firm* — Polly C. Owen

(57) ABSTRACT

A process of making a paper or nonwoven article is provide. The process comprising:

a) providing a fiber furnish comprising a plurality of fibers and a plurality of binder microfibers, wherein the binder microfibers comprise a water non-dispersible, synthetic polymer; wherein the binder microfibers have a length of less than 25 millimeters and a fineness of less than 0.5 d/f; and wherein the binder microfibers have a melting temperature that is less than the melting temperature of the fibers;

b) routing the fiber furnish to a wet-laid nonwoven process to produce at least one wet-laid nonwoven web layer;

c) removing water from the wet-laid nonwoven web layer; and d) thermally bonding the wet-laid nonwoven web layer after step (c); wherein the thermal bonding is conducted at a temperature such that the surfaces of the binder microfibers at least partially melt without causing the fibers to melt thereby bonding the binder microfibers to the fibers to produce the paper or nonwoven article.

17 Claims, 3 Drawing Sheets

(56) References Cited

U.S. PATENT DOCUMENTS 4,073,777 A 2/1978 O'Neill et al.
4,073,988 A 2/1978 Nishida et al.
4,100,324 A 7/1978 Anderson et al.
4,104,262 A 8/1978 Schade
4,121,966 A 10/1978 Amano et al.
4,127,696 A 11/1978 Okamoto
4,137,393 A 1/1979 Sidebotham et al.
4,145,469 A 3/1979 Newkirk et al.
4,226,672 A 10/1980 Absolon et al.
4,233,355 A 11/1980 Sato et al.
4,234,652 A 11/1980 Vanoni et al.
4,239,720 A 12/1980 Gerlach et al.
4,240,918 A 12/1980 Lagasse et al.
4,243,480 A 1/1981 Hernandez et al.
4,288,503 A 9/1981 Goldberg
4,297,412 A 10/1981 Achard et al.
4,299,654 A 11/1981 Tlach et al.
4,302,495 A 11/1981 Marra
4,304,901 A 12/1981 O'Neill et al.
4,342,801 A 8/1982 Gerlach et al.
4,350,006 A 9/1982 Okamoto et al.
4,365,041 A 12/1982 Okamoto et al.
4,381,335 A 4/1983 Okamoto
4,410,579 A 10/1983 Johns
4,427,557 A 1/1984 Stockburger
4,460,649 A 7/1984 Park et al.
4,480,085 A 10/1984 Larson
4,496,619 A 1/1985 Okamoto
4,517,715 A 5/1985 Yoshida et al.
4,552,909 A 11/1985 Czerwinski et al.
4,569,343 A 2/1986 Kimura et al.
4,618,524 A 10/1986 Groitzsch et al.
4,647,497 A 3/1987 Weeks
4,652,341 A 3/1987 Prior
4,699,845 A 10/1987 Oikawa et al.
4,710,432 A 12/1987 Nishimura et al.
4,738,785 A 4/1988 Langston et al.
4,755,421 A 7/1988 Manning et al.
4,795,668 A 1/1989 Krueger et al.
4,804,719 A 2/1989 Weaver et al.
4,810,775 A 3/1989 Bendix et al.
4,863,785 A 9/1989 Berman et al.
4,873,273 A 10/1989 Allan et al.
4,910,292 A 3/1990 Blount
4,921,899 A 5/1990 Phan et al.
4,940,744 A 7/1990 Tortorici et al.
4,943,477 A 7/1990 Kanamura et al.
4,946,932 A 8/1990 Jenkins
4,966,808 A * 10/1990 Kawano ..... 442/201
4,973,656 A 11/1990 Blount
4,990,593 A 2/1991 Blount
4,996,252 A 2/1991 Phan et al.
5,006,598 A 4/1991 Adams et al.
5,039,339 A 8/1991 Phan et al.
5,057,368 A 10/1991 Largman et al.
5,069,970 A 12/1991 Largman et al.
5,073,436 A 12/1991 Antonacci et al.
5,108,820 A 4/1992 Kaneko et al.
5,124,194 A 6/1992 Kawano
5,158,844 A 10/1992 Hagens et al.
5,162,074 A 11/1992 Hills
5,162,399 A 11/1992 Sharma et al.
5,171,767 A 12/1992 Buckley et al.
5,176,952 A 1/1993 Joseph et al.
5,218,042 A 6/1993 Kuo et al.
5,242,640 A 9/1993 Butler et al.
5,254,399 A 10/1993 Oku et al.
5,258,220 A 11/1993 Joseph
5,262,460 A 11/1993 Suzuki et al.
5,274,025 A 12/1993 Stockl et al.
5,277,976 A 1/1994 Hogle et al.
5,281,306 A 1/1994 Kakiuchi et al.
5,286,843 A 2/1994 Wood
5,290,626 A 3/1994 Nishioi et al.
5,290,631 A 3/1994 Fleury et al.
5,290,654 A 3/1994 Sacripante et al.
5,292,075 A 3/1994 Bartlett
5,292,581 A 3/1994 Viazmensky et al.
5,292,855 A 3/1994 Krutak et al.
5,296,286 A 3/1994 Allen et al.
5,308,697 A 5/1994 Muramoto et al.
5,336,552 A 8/1994 Strack et al.
5,338,406 A 8/1994 Smith
5,342,863 A 8/1994 Buckley et al.
5,366,804 A 11/1994 Dugan
5,368,928 A 11/1994 Okamura et al.
5,369,210 A 11/1994 George et al.
5,369,211 A 11/1994 George et al.
5,374,357 A 12/1994 Comstock et al.
5,375,306 A 12/1994 Roussin-Moynier
5,378,757 A 1/1995 Blount, Jr. et al.
5,382,400 A 1/1995 Pike et al.
5,386,003 A 1/1995 Greene et al.
5,389,068 A 2/1995 Keck
5,395,693 A 3/1995 Cho et al.
5,405,698 A 4/1995 Dugan
5,416,156 A 5/1995 Kamen
5,423,432 A 6/1995 Krutak et al.
5,431,994 A 7/1995 Kozulla
5,446,079 A 8/1995 Buchanan et al.
5,449,464 A 9/1995 El-Shall
5,456,982 A 10/1995 Hansen et al.
5,466,410 A 11/1995 Hills
5,466,518 A 11/1995 Isaac et al.
5,468,536 A 11/1995 Whitcomb et al.
5,472,600 A 12/1995 Ellefson et al.
5,482,772 A 1/1996 Strack et al.
5,486,418 A 1/1996 Ohmory et al.
5,496,627 A 3/1996 Bagrodia et al.
5,498,468 A 3/1996 Blaney
5,502,091 A 3/1996 Dasgupta
5,508,101 A 4/1996 Patnode et al.
5,509,913 A 4/1996 Yeo
5,525,282 A 6/1996 Dugan
5,530,059 A 6/1996 Blount, Jr. et al.
5,536,811 A 7/1996 Wood
5,543,488 A 8/1996 Miller et al.
5,545,464 A 8/1996 Stokes
5,545,481 A 8/1996 Harrington
5,552,495 A 9/1996 Miller et al.
5,559,171 A 9/1996 Buchanan et al.
5,559,205 A 9/1996 Hansen et al.
5,567,510 A 10/1996 Patnode et al.
5,571,620 A 11/1996 George et al.
5,575,918 A 11/1996 Virnig et al.
5,580,911 A 12/1996 Buchanan et al.
5,593,778 A 1/1997 Kondo et al.
5,593,807 A 1/1997 Sacripante et al.
5,599,858 A 2/1997 Buchanan et al.
5,605,746 A 2/1997 Groeger et al.
5,607,491 A 3/1997 Jackson et al.
5,607,765 A 3/1997 Hansen et al.
5,620,785 A 4/1997 Watt et al.
5,630,972 A 5/1997 Patnode et al.
5,635,071 A 6/1997 Al-Samadi
5,637,385 A 6/1997 Mizuki et al.
5,643,662 A 7/1997 Yeo et al.
5,646,237 A 7/1997 George et al.
5,652,048 A 7/1997 Haynes et al.
5,654,086 A 8/1997 Nishijima et al.
5,658,704 A 8/1997 Patel et al.
5,660,965 A 8/1997 Mychajlowskij et al.
5,672,415 A 9/1997 Sawyer et al.
5,688,582 A 11/1997 Nagaoka et al.
5,698,331 A 12/1997 Matsumura et al.
5,709,940 A 1/1998 George et al.
5,736,083 A 4/1998 Dugan
5,750,605 A 5/1998 Blumenthal et al.
5,753,351 A 5/1998 Yoshida et al.
5,759,926 A 6/1998 Pike et al.
5,762,758 A 6/1998 Hoffman
5,763,065 A 6/1998 Patnode et al.
5,779,736 A 7/1998 Frederick et al.
5,783,503 A 7/1998 Gillespie et al.

(56) References Cited

U.S. PATENT DOCUMENTS 5,785,725 A 7/1998 Cusick et al.
5,798,078 A 8/1998 Myers
5,817,740 A 10/1998 Anderson et al.
5,820,982 A 10/1998 Salsman
5,837,658 A 11/1998 Stork
5,843,311 A 12/1998 Richter et al.
5,853,701 A 12/1998 George et al.
5,853,944 A 12/1998 Foucher et al.
5,871,845 A 2/1999 Dahringer et al.
5,883,181 A 3/1999 Cicchiello et al.
5,888,916 A 3/1999 Tadokoro et al.
5,895,710 A 4/1999 Sasse et al.
5,916,678 A 6/1999 Jackson et al.
5,916,687 A 6/1999 Takanashi et al.
5,916,725 A 6/1999 Patel et al.
5,916,935 A 6/1999 Wiggins et al.
5,935,880 A 8/1999 Wang et al.
5,935,883 A 8/1999 Pike
5,935,884 A * 8/1999 Williams et al. ..... 442/364
5,948,710 A 9/1999 Pomplun et al.
5,952,251 A 9/1999 Jackson et al.
5,954,967 A 9/1999 Egraz et al.
5,970,583 A 10/1999 Groten et al.
5,976,694 A 11/1999 Tsai et al.
5,993,668 A 11/1999 Duan
5,993,834 A 11/1999 Shah et al.
6,004,673 A 12/1999 Nishijima
6,007,910 A 12/1999 Miller et al.
6,020,420 A 2/2000 George
6,037,055 A 3/2000 Aneja et al.
6,057,388 A 5/2000 Wiggins et al.
6,080,471 A 6/2000 Shigematsu et al.
6,090,731 A 7/2000 Pike et al.
6,110,249 A 8/2000 Medcalf et al.
6,110,588 A 8/2000 Perez et al.
6,110,636 A 8/2000 Foucher et al.
6,114,407 A 9/2000 Myers
6,120,889 A 9/2000 Turner et al.
6,121,170 A 9/2000 Tsai et al.
6,162,340 A 12/2000 Zakikhani
6,162,890 A 12/2000 George et al.
6,168,719 B1 1/2001 Shimokawa et al.
6,171,685 B1 1/2001 George et al.
6,174,602 B1 1/2001 Matsui et al.
6,177,193 B1 1/2001 Tsai et al.
6,177,607 B1 1/2001 Blaney et al.
6,183,648 B1 2/2001 Kozak et al.
6,194,517 B1 2/2001 Pomplun et al.
6,200,669 B1 3/2001 Marmon et al.
6,211,309 B1 4/2001 McIntosh et al.
6,218,321 B1 4/2001 Lorcks et al.
6,225,243 B1 5/2001 Austin
6,235,392 B1 5/2001 Luo et al.
6,248,809 B1 6/2001 Buckley et al.
6,294,645 B1 9/2001 Allen et al.
6,296,933 B1 10/2001 Goda et al.
6,300,306 B1 10/2001 Firkins et al.
6,316,592 B1 11/2001 Bates et al.
6,322,887 B1 11/2001 Matsui et al.
6,331,606 B1 12/2001 Sun
6,332,994 B1 12/2001 Karageorgiou
6,335,092 B1 1/2002 Takeda et al.
6,348,679 B1 2/2002 Ryan et al.
6,352,948 B1 3/2002 Pike et al.
6,355,137 B1 3/2002 Staib
6,361,784 B1 3/2002 Brennan et al.
6,365,697 B1 4/2002 Kim et al.
6,369,136 B2 4/2002 Sorriero et al.
6,381,817 B1 5/2002 Moody, III
6,384,108 B1 5/2002 Breton et al.
6,402,870 B1 6/2002 Groten et al.
6,403,677 B1 6/2002 Walker
6,417,251 B1 7/2002 Brady
6,420,024 B1 7/2002 Perez et al.
6,420,027 B2 7/2002 Kimura et al.
6,428,900 B1 8/2002 Wang
6,429,253 B1 8/2002 Guerro et al.
6,430,348 B1 8/2002 Asano et al.
6,432,532 B2 8/2002 Perez et al.
6,432,850 B1 8/2002 Takagi et al.
6,436,855 B1 8/2002 Iwata et al.
6,440,556 B2 8/2002 Matsui et al.
6,441,267 B1 8/2002 Dugan
6,471,910 B1 10/2002 Haggard
6,488,731 B2 12/2002 Schultheiss et al.
6,506,853 B2 1/2003 Duan
6,509,092 B1 1/2003 Dugan
6,512,024 B1 1/2003 Lundgard et al.
6,533,938 B1 3/2003 Dillorio et al.
6,541,175 B1 4/2003 Jiang et al.
6,548,592 B1 4/2003 Lang et al.
6,550,622 B2 4/2003 Koslow
6,551,353 B1 4/2003 Baker et al.
6,552,123 B1 4/2003 Katayama et al.
6,552,162 B1 4/2003 Wang et al.
6,554,881 B1 4/2003 Healey
6,573,204 B1 6/2003 Philipp et al.
6,576,716 B1 6/2003 Wo
6,579,466 B1 6/2003 David et al.
6,583,075 B1 6/2003 Dugan
6,586,529 B2 7/2003 Mumick et al.
6,589,426 B1 7/2003 Husain et al.
6,602,386 B1 * 8/2003 Takeuchi et al. ..... 162/115
6,602,955 B2 8/2003 Soerens et al.
H002086 H 10/2003 Amsler
6,638,677 B2 10/2003 Patel et al.
6,657,017 B2 12/2003 Wo et al.
6,664,437 B2 12/2003 Sawyer et al.
6,692,825 B2 2/2004 Qin et al.
6,706,652 B2 3/2004 Groten et al.
6,720,063 B2 4/2004 Kobayashi et al.
6,730,387 B2 5/2004 Rezai et al.
6,743,506 B2 6/2004 Bond et al.
6,746,766 B2 6/2004 Bond et al.
6,746,779 B2 6/2004 Hayes et al.
6,759,124 B2 7/2004 Royer et al.
6,764,802 B2 7/2004 Maric et al.
6,767,498 B1 7/2004 Talley, Jr. et al.
6,776,858 B2 8/2004 Bansal et al.
6,780,560 B2 8/2004 Farrugia et al.
6,780,942 B2 8/2004 Leon et al.
6,787,245 B1 9/2004 Hayes
6,787,425 B1 9/2004 Rotondaro et al.
6,815,382 B1 11/2004 Groten et al.
6,821,672 B2 * 11/2004 Zguris ..... 429/144
6,838,172 B2 1/2005 Yoon et al.
6,838,403 B2 1/2005 Tsai et al.
6,841,038 B2 1/2005 Horenziak et al.
6,844,062 B2 1/2005 Matsui et al.
6,844,063 B2 1/2005 Matsui et al.
6,849,329 B2 2/2005 Perez et al.
6,855,422 B2 2/2005 Magill et al.
6,860,906 B2 3/2005 Malisz et al.
6,861,142 B1 3/2005 Wilkie et al.
6,890,649 B2 5/2005 Hobbs et al.
6,893,711 B2 5/2005 Williamson et al.
6,900,148 B2 5/2005 Yoneda et al.
6,902,796 B2 6/2005 Morell et al.
6,946,506 B2 9/2005 Bond et al.
6,949,288 B2 9/2005 Hodge et al.
6,953,622 B2 10/2005 Tsai et al.
6,989,193 B2 1/2006 Haile et al.
6,989,194 B2 1/2006 Bansal et al.
7,008,485 B2 3/2006 Heikkila et al.
7,011,653 B2 3/2006 Imsangjan et al.
7,011,885 B2 3/2006 Chang et al.
7,014,803 B2 3/2006 Perez et al.
7,022,201 B2 4/2006 Anderson et al.
7,025,885 B2 4/2006 Cote et al.
7,026,033 B2 4/2006 Fujimori et al.
7,070,695 B2 7/2006 Husain et al.
7,087,301 B2 8/2006 Musgrave et al.
7,091,140 B1 8/2006 Ferencz et al.
7,097,904 B2 8/2006 Ochi et al.

(56) References Cited

U.S. PATENT DOCUMENTS

| | | | |
|---|---|---|---|
| 7,112,389 | B1 | 9/2006 | Arora et al. |
| 7,144,614 | B2 | 12/2006 | Nakajima et al. |
| 7,160,612 | B2 | 1/2007 | Magill et al. |
| 7,163,744 | B2 | 1/2007 | Nightingale et al. |
| 7,166,225 | B2 | 1/2007 | Pitt et al. |
| 7,179,376 | B2 | 2/2007 | Kaleem et al. |
| 7,186,343 | B2 | 3/2007 | Rabie et al. |
| 7,186,344 | B2 | 3/2007 | Hughes |
| 7,193,029 | B2 | 3/2007 | Hayes |
| 7,194,788 | B2 | 3/2007 | Clark et al. |
| 7,195,814 | B2 | 3/2007 | Ista et al. |
| 7,214,765 | B2 | 5/2007 | Ringeisen et al. |
| 7,220,815 | B2 | 5/2007 | Hayes |
| 7,238,415 | B2 | 7/2007 | Rodriguez et al. |
| 7,238,423 | B2 | 7/2007 | Calhoun et al. |
| 7,241,497 | B2 | 7/2007 | Magill et al. |
| 7,276,139 | B2 | 10/2007 | Katai et al. |
| 7,285,209 | B2 | 10/2007 | Yu et al. |
| 7,291,270 | B2 | 11/2007 | Gibson et al. |
| 7,291,389 | B1 | 11/2007 | Bitler et al. |
| 7,304,125 | B2 | 12/2007 | Ibar |
| 7,306,735 | B2 | 12/2007 | Baggott et al. |
| 7,309,372 | B2 | 12/2007 | Kahlbaugh et al. |
| 7,314,497 | B2 | 1/2008 | Kahlbaugh et al. |
| 7,329,723 | B2 | 2/2008 | Jernigan et al. |
| 7,338,664 | B2 | 3/2008 | Tseng et al. |
| 7,344,775 | B2 | 3/2008 | Stevens et al. |
| 7,347,947 | B2 | 3/2008 | Nakamura et al. |
| 7,357,985 | B2 | 4/2008 | Kurian et al. |
| 7,358,022 | B2 | 4/2008 | Farrugia et al. |
| 7,358,323 | B2 | 4/2008 | Maeda et al. |
| 7,358,325 | B2 | 4/2008 | Hayes |
| 7,361,700 | B2 | 4/2008 | Sunamori et al. |
| 7,365,118 | B2 | 4/2008 | McCleskey et al. |
| 7,371,701 | B2 | 5/2008 | Inagaki |
| 7,387,976 | B2 | 6/2008 | Baba et al. |
| 7,388,058 | B2 | 6/2008 | Kaku et al. |
| 7,405,171 | B2 | 7/2008 | Tsujiyama et al. |
| 7,405,266 | B2 | 7/2008 | Bentley et al. |
| 7,407,514 | B2 | 8/2008 | Li et al. |
| 7,432,219 | B2 | 10/2008 | Strandqvist et al. |
| 7,442,277 | B2 | 10/2008 | Kupper et al. |
| 7,462,386 | B2 | 12/2008 | Yamasaki et al. |
| 7,497,895 | B2 | 3/2009 | Sabottke |
| 7,513,004 | B2 | 4/2009 | Luckman et al. |
| 7,544,444 | B2 | 6/2009 | Adachi et al. |
| 7,560,159 | B2 | 7/2009 | Goda et al. |
| 7,576,019 | B2 | 8/2009 | Bond et al. |
| 7,588,688 | B2 | 9/2009 | Butters et al. |
| 7,622,188 | B2 | 11/2009 | Kamiyama et al. |
| 7,635,745 | B2 | 12/2009 | Gupta et al. |
| 7,655,070 | B1 | 2/2010 | Dallas et al. |
| 7,660,040 | B2 | 2/2010 | Starry et al. |
| 7,666,500 | B2 | 2/2010 | Magill et al. |
| 7,666,502 | B2 | 2/2010 | Magill et al. |
| 7,666,504 | B2 | 2/2010 | Ochi et al. |
| 7,674,510 | B2 | 3/2010 | Kamiya |
| 7,687,143 | B2 | 3/2010 | Gupta et al. |
| 7,695,812 | B2 | 4/2010 | Peng et al. |
| 7,696,111 | B2 | 4/2010 | Mangold et al. |
| 7,704,595 | B2 | 4/2010 | Morin |
| 7,718,104 | B2 | 5/2010 | MacDonald et al. |
| 7,727,627 | B2 | 6/2010 | Sen et al. |
| 7,732,357 | B2 | 6/2010 | Annis et al. |
| 7,732,557 | B2 | 6/2010 | Phelps et al. |
| 7,736,737 | B2 | 6/2010 | Van Dun et al. |
| 7,737,060 | B2 | 6/2010 | Strickler et al. |
| 7,744,807 | B2 | 6/2010 | Berrigan et al. |
| 7,754,123 | B2 | 7/2010 | Verdegan et al. |
| 7,757,811 | B2 | 7/2010 | Fox et al. |
| 7,765,647 | B2 | 8/2010 | Smith et al. |
| 7,772,456 | B2 | 8/2010 | Zhang et al. |
| 7,820,568 | B2 | 10/2010 | Horiguchi et al. |
| 7,837,814 | B2 | 11/2010 | Minami et al. |
| 7,858,732 | B2 | 12/2010 | Bruchmann et al. |
| 7,883,604 | B2 | 2/2011 | Dyer et al. |
| 7,884,037 | B2 | 2/2011 | Sirovatka et al. |
| 7,887,526 | B2 | 2/2011 | Van Gompel et al. |
| 7,892,672 | B2 | 2/2011 | Nishikawa |
| 7,892,992 | B2 | 2/2011 | Kamada et al. |
| 7,892,993 | B2 | 2/2011 | Gupta et al. |
| 7,896,940 | B2 | 3/2011 | Sundet et al. |
| 7,897,078 | B2 | 3/2011 | Petersen et al. |
| 7,897,248 | B2 | 3/2011 | Barrera et al. |
| 7,902,094 | B2 | 3/2011 | Haile et al. |
| 7,902,096 | B2 | 3/2011 | Brandner et al. |
| 7,910,207 | B2 | 3/2011 | Kamiyama et al. |
| 7,914,866 | B2 | 3/2011 | Shannon et al. |
| 7,918,313 | B2 | 4/2011 | Gross et al. |
| 7,919,419 | B2 | 4/2011 | Hurley et al. |
| 7,922,959 | B2 | 4/2011 | Jones et al. |
| 7,923,143 | B2 | 4/2011 | Tanaka et al. |
| 7,928,025 | B2 | 4/2011 | Shipley et al. |
| 7,931,457 | B2 | 4/2011 | Johnson et al. |
| 7,932,192 | B2 | 4/2011 | Fujisawa et al. |
| 7,935,645 | B2 | 5/2011 | Pourdeyhimi et al. |
| 7,947,142 | B2 | 5/2011 | Fox et al. |
| 7,947,864 | B2 | 5/2011 | Damay et al. |
| 7,951,313 | B2 | 5/2011 | Matsubayashi et al. |
| 7,951,452 | B2 | 5/2011 | Nakayama et al. |
| 7,959,848 | B2 | 6/2011 | Reneker et al. |
| 8,021,457 | B2 | 9/2011 | Dema et al. |
| 8,057,567 | B2 | 11/2011 | Webb et al. |
| 8,129,019 | B2 | 3/2012 | Pourdeyhimi et al. |
| 8,148,278 | B2 | 4/2012 | Gupta et al. |
| 8,158,244 | B2 | 4/2012 | Gupta et al. |
| 8,163,385 | B2 | 4/2012 | Gupta et al. |
| 8,178,199 | B2 | 5/2012 | Gupta et al. |
| 8,216,953 | B2 | 7/2012 | Haile et al. |
| 8,227,362 | B2 | 7/2012 | Haile et al. |
| 8,236,713 | B2 | 8/2012 | Haile et al. |
| 8,247,335 | B2 | 8/2012 | Haile et al. |
| 8,257,628 | B2 | 9/2012 | Gupta et al. |
| 8,262,958 | B2 | 9/2012 | Haile et al. |
| 8,273,451 | B2 | 9/2012 | Gupta et al. |
| 8,277,706 | B2 | 10/2012 | Gupta et al. |
| 8,314,041 | B2 | 11/2012 | Gupta et al. |
| 8,388,877 | B2 | 3/2013 | Gupta et al. |
| 8,398,907 | B2 | 3/2013 | Gupta et al. |
| 8,435,908 | B2 | 5/2013 | Haile et al. |
| 8,444,895 | B2 | 5/2013 | Haile et al. |
| 8,444,896 | B2 | 5/2013 | Haile et al. |
| 8,465,565 | B2 | 6/2013 | Calis et al. |
| 8,512,519 | B2 | 8/2013 | Gupta et al. |
| 8,513,147 | B2 | 8/2013 | Gupta et al. |
| 8,557,374 | B2 | 10/2013 | Gupta et al. |
| 8,613,363 | B2 * | 12/2013 | Koslow ..... 210/501 |
| 8,623,247 | B2 | 1/2014 | Haile et al. |
| 8,871,052 | B2 | 10/2014 | Parker et al. |
| 8,980,774 | B2 * | 3/2015 | Zhang et al. ..... 442/154 |
| 9,273,417 | B2 | 3/2016 | Gupta et al. |
| 9,303,357 | B2 | 4/2016 | Clark et al. |
| 2002/0009590 | A1 | 1/2002 | Matsui et al. |
| 2002/0030016 | A1 | 3/2002 | Schmidt |
| 2002/0079121 | A1 | 6/2002 | Ryan et al. |
| 2002/0090876 | A1 | 7/2002 | Takase et al. |
| 2002/0100728 | A1 | 8/2002 | Poncelet |
| 2002/0106510 | A1 * | 8/2002 | Deguchi et al. ..... 428/364 |
| 2002/0123290 | A1 | 9/2002 | Tsai et al. |
| 2002/0127937 | A1 | 9/2002 | Lange et al. |
| 2002/0127939 | A1 | 9/2002 | Hwo et al. |
| 2002/0146552 | A1 | 10/2002 | Mumick et al. |
| 2002/0187329 | A1 | 12/2002 | Ista et al. |
| 2003/0024878 | A1 | 2/2003 | Baltussen et al. |
| 2003/0026986 | A1 | 2/2003 | Matsui et al. |
| 2003/0057155 | A1 | 3/2003 | Husain et al. |
| 2003/0077444 | A1 | 4/2003 | Bond et al. |
| 2003/0091822 | A1 | 5/2003 | Bond et al. |
| 2003/0092343 | A1 | 5/2003 | Bond et al. |
| 2003/0104204 | A1 | 6/2003 | Bond et al. |
| 2003/0111763 | A1 | 6/2003 | Jen |
| 2003/0166370 | A1 | 9/2003 | Harris et al. |
| 2003/0166371 | A1 | 9/2003 | Fingal et al. |
| 2003/0168191 | A1 | 9/2003 | Hansen et al. |

(56) References Cited

U.S. PATENT DOCUMENTS

2003/0176132 A1 9/2003 Moriyasu et al.
2003/0194558 A1 10/2003 Anderson
2003/0196955 A1 10/2003 Hughes
2004/0054331 A1 3/2004 Hamilton et al.
2004/0081829 A1 4/2004 Klier et al.
2004/0157037 A1 8/2004 Yamaguchi et al.
2004/0194558 A1 10/2004 Nagase
2004/0209058 A1 10/2004 Chou et al.
2004/0211729 A1 10/2004 Sunkara et al.
2004/0214495 A1 10/2004 Foss et al.
2004/0242106 A1 12/2004 Rabasco et al.
2004/0242838 A1 12/2004 Duan
2004/0258910 A1* 12/2004 Haile ..... A61K 8/85 428/364
2004/0260034 A1 12/2004 Haile et al.
2005/0026527 A1 2/2005 Schmidt
2005/0027098 A1 2/2005 Hayes
2005/0032450 A1 2/2005 Haggard et al.
2005/0079781 A1 4/2005 Tsujimoto et al.
2005/0115902 A1 6/2005 Kaleem et al.
2005/0125908 A1 6/2005 Pourdeyhimi
2005/0148261 A1 7/2005 Close et al.
2005/0171250 A1 8/2005 Hayes
2005/0208300 A1 9/2005 Magill et al.
2005/0215157 A1 9/2005 Dugan et al.
2005/0221709 A1 10/2005 Jordan et al.
2005/0222956 A1 10/2005 Bristow et al.
2005/0227068 A1 10/2005 Dugan
2005/0239359 A1 10/2005 Jones et al.
2005/0282008 A1 12/2005 Haile et al.
2005/0287895 A1 12/2005 Bansal
2006/0011544 A1 1/2006 Sharma et al.
2006/0019570 A1 1/2006 Groten et al.
2006/0021938 A1 2/2006 Diallo
2006/0030230 A1 2/2006 Nagaoka et al.
2006/0035556 A1 2/2006 Yokoi et al.
2006/0049386 A1 3/2006 Kody et al.
2006/0051575 A1 3/2006 Yoon et al.
2006/0057350 A1 3/2006 Ochi et al.
2006/0057373 A1 3/2006 Inagaki et al.
2006/0060529 A1 3/2006 Cote et al.
2006/0065600 A1 3/2006 Sunkara et al.
2006/0081330 A1 4/2006 Minami et al.
2006/0083917 A1 4/2006 Dugan
2006/0093814 A1 5/2006 Chang
2006/0093819 A1 5/2006 Atwood et al.
2006/0113033 A1 6/2006 Bruner
2006/0128247 A1 6/2006 Skoog et al.
2006/0135020 A1 6/2006 Weinberg et al.
2006/0147709 A1 7/2006 Mizumura et al.
2006/0155094 A1 7/2006 Meckel et al.
2006/0159918 A1 7/2006 Dugan et al.
2006/0177656 A1 8/2006 Kolmes et al.
2006/0189956 A1 8/2006 Catalan
2006/0194027 A1 8/2006 Pourdeyhimi et al.
2006/0194047 A1 8/2006 Gupta et al.
2006/0204753 A1 9/2006 Simmonds et al.
2006/0210797 A1 9/2006 Masuda et al.
2006/0230731 A1 10/2006 Kalayci et al.
2006/0234049 A1 10/2006 Van Dun et al.
2006/0234050 A1 10/2006 Frankel
2006/0234587 A1 10/2006 Horiguchi et al.
2006/0263601 A1 11/2006 Wang et al.
2006/0281383 A1 12/2006 Schmitt et al.
2007/0009736 A1 1/2007 Chuang et al.
2007/0020453 A1 1/2007 Sen et al.
2007/0021021 A1 1/2007 Verdegan et al.
2007/0031637 A1 2/2007 Anderson
2007/0031668 A1 2/2007 Hietpas et al.
2007/0039889 A1 2/2007 Ashford
2007/0048523 A1 3/2007 Pollet et al.
2007/0056906 A1 3/2007 Kaleem et al.
2007/0062872 A1 3/2007 Parker et al.
2007/0074628 A1 4/2007 Jones et al.
2007/0077427 A1 4/2007 Dugan
2007/0098982 A1 5/2007 Nishida et al.
2007/0102361 A1 5/2007 Kiefer et al.
2007/0110980 A1 5/2007 Shah
2007/0110998 A1 5/2007 Steele et al.
2007/0114177 A1 5/2007 Sabottke
2007/0122613 A1 5/2007 Stevens et al.
2007/0122614 A1 5/2007 Peng et al.
2007/0128404 A1 6/2007 Tung et al.
2007/0167096 A1 7/2007 Scott
2007/0179275 A1 8/2007 Gupta et al.
2007/0182040 A1 8/2007 Suzuki et al.
2007/0190319 A1 8/2007 Kalayci
2007/0232179 A1 10/2007 Polat et al.
2007/0232180 A1 10/2007 Polat et al.
2007/0243377 A1 10/2007 Nishida et al.
2007/0254153 A1 11/2007 Nadkarni et al.
2007/0258935 A1 11/2007 McEntire et al.
2007/0259029 A1 11/2007 McEntire et al.
2007/0259177 A1 11/2007 Gupta et al.
2007/0264520 A1 11/2007 Wood et al.
2007/0278151 A1 12/2007 Musale
2007/0278152 A1 12/2007 Musale
2008/0000836 A1 1/2008 Wang et al.
2008/0003400 A1 1/2008 Tseng
2008/0003905 A1 1/2008 Tseng et al.
2008/0003912 A1 1/2008 Pourdeyhimi et al.
2008/0009574 A1 1/2008 Huenefeld et al.
2008/0009650 A1 1/2008 Sluijmers et al.
2008/0011680 A1 1/2008 Partridge et al.
2008/0038974 A1 2/2008 Eagles
2008/0039540 A1 2/2008 Reitz
2008/0064285 A1 3/2008 Morton et al.
2008/0134652 A1 6/2008 Lim et al.
2008/0152282 A1 6/2008 Ouderkirk et al.
2008/0160278 A1 7/2008 Cheng et al.
2008/0160856 A1 7/2008 Chen et al.
2008/0160859 A1 7/2008 Gupta et al.
2008/0170982 A1 7/2008 Zhang et al.
2008/0188151 A1 8/2008 Yokoi et al.
2008/0207833 A1 8/2008 Bear et al.
2008/0229672 A1 9/2008 Woo et al.
2008/0233850 A1 9/2008 Woo et al.
2008/0245037 A1 10/2008 Rogers et al.
2008/0264586 A1 10/2008 Likitalo et al.
2008/0287026 A1 11/2008 Chakravarty et al.
2008/0305389 A1 12/2008 Arora et al.
2008/0311815 A1* 12/2008 Gupta et al. ..... 442/351
2009/0025895 A1 1/2009 Cowman
2009/0036015 A1 2/2009 Nhan et al.
2009/0042475 A1 2/2009 Pourdeyhimi et al.
2009/0163449 A1 6/2009 Wempe
2009/0249956 A1 10/2009 Chi et al.
2009/0258182 A1 10/2009 Okamoto et al.
2009/0274862 A1 11/2009 Nakayama et al.
2009/0294435 A1 12/2009 Nhan et al.
2009/0305592 A1 12/2009 Shi et al.
2010/0018660 A1 1/2010 Varnell
2010/0035500 A1 2/2010 Kimura et al.
2010/0044289 A1* 2/2010 Koslow ..... 210/167.02
2010/0072126 A1 3/2010 Tsujimoto et al.
2010/0112325 A1 5/2010 Iwamoto et al.
2010/0133173 A1 6/2010 Inagaki
2010/0133197 A1 6/2010 Langner
2010/0136312 A1 6/2010 Inagaki
2010/0143717 A1 6/2010 Sakamoto et al.
2010/0143731 A1 6/2010 DeZurik et al.
2010/0173154 A1 7/2010 Shimotsu et al.
2010/0180558 A1 7/2010 Ito et al.
2010/0187712 A1 7/2010 Gupta et al.
2010/0197027 A1 8/2010 Zhang et al.
2010/0200512 A1 8/2010 Chase et al.
2010/0203788 A1 8/2010 Kimura et al.
2010/0247894 A1 9/2010 Beard
2010/0272938 A1 10/2010 Mitchell et al.
2010/0273947 A1 10/2010 Miyauchi et al.
2010/0282682 A1 11/2010 Eaton et al.
2010/0285101 A1 11/2010 Moore et al.
2010/0291213 A1 11/2010 Berrigan et al.
2010/0310921 A1 12/2010 Hayakawa et al.

(56) References Cited

U.S. PATENT DOCUMENTS

| | | | | |
|---|---|---|---|---|
| 2011/0020590 | A1 | 1/2011 | Yoneda et al. | |
| 2011/0030885 | A1 | 2/2011 | Anneaux et al. | |
| 2011/0033705 | A1 | 2/2011 | Komura et al. | |
| 2011/0036487 | A1 | 2/2011 | Rajala et al. | |
| 2011/0039055 | A1 | 2/2011 | Fujisawa et al. | |
| 2011/0039468 | A1 | 2/2011 | Baldwin, Jr. et al. | |
| 2011/0040277 | A1 | 2/2011 | Rajala et al. | |
| 2011/0041471 | A1 | 2/2011 | Sebastian et al. | |
| 2011/0045042 | A1 | 2/2011 | Sasaki et al. | |
| 2011/0045231 | A1 | 2/2011 | Kajiwara et al. | |
| 2011/0045261 | A1 | 2/2011 | Sellars | |
| 2011/0046461 | A1 | 2/2011 | McKenna | |
| 2011/0049769 | A1 | 3/2011 | Duchoslav et al. | |
| 2011/0054429 | A1 | 3/2011 | Lademann et al. | |
| 2011/0056638 | A1 | 3/2011 | Rosset | |
| 2011/0059669 | A1 | 3/2011 | He et al. | |
| 2011/0064928 | A1 | 3/2011 | Bonneh | |
| 2011/0065573 | A1 | 3/2011 | McEneany et al. | |
| 2011/0065871 | A1 | 3/2011 | Nagano et al. | |
| 2011/0067369 | A1 | 3/2011 | Chung et al. | |
| 2011/0068507 | A1 | 3/2011 | Warren et al. | |
| 2011/0074060 | A1 | 3/2011 | Angadjivand et al. | |
| 2011/0076250 | A1 | 3/2011 | Belenkaya et al. | |
| 2011/0084028 | A1 | 4/2011 | Stanfel et al. | |
| 2011/0091761 | A1 | 4/2011 | Miller et al. | |
| 2011/0094515 | A1 | 4/2011 | Duffy | |
| 2011/0104493 | A1 | 5/2011 | Barnholtz et al. | |
| 2011/0114274 | A1 | 5/2011 | Takano et al. | |
| 2011/0117176 | A1 | 5/2011 | Klun et al. | |
| 2011/0117353 | A1 | 5/2011 | Henshaw et al. | |
| 2011/0117439 | A1 | 5/2011 | Yamada et al. | |
| 2011/0123584 | A1 | 5/2011 | Seidling et al. | |
| 2011/0124769 | A1 | 5/2011 | Moen et al. | |
| 2011/0124835 | A1 | 5/2011 | DeWeijer et al. | |
| 2011/0129510 | A1 | 6/2011 | Liebmann et al. | |
| 2011/0130063 | A1 | 6/2011 | Matsubayashi et al. | |
| 2011/0139386 | A1 | 6/2011 | Gupta et al. | |
| 2011/0142900 | A1 | 6/2011 | Ohta et al. | |
| 2011/0143110 | A1 | 6/2011 | Tsuchiya et al. | |
| 2011/0147299 | A1 | 6/2011 | Stanfel et al. | |
| 2011/0168625 | A1 | 7/2011 | Gupta et al. | |
| 2011/0171535 | A1 | 7/2011 | Ohinshi et al. | |
| 2011/0171890 | A1 | 7/2011 | Nakayama et al. | |
| 2012/0015577 | A1 | 1/2012 | Rudman et al. | |
| 2012/0175074 | A1* | 7/2012 | Gupta et al. | 162/146 |
| 2012/0175298 | A1* | 7/2012 | Gupta et al. | 210/496 |
| 2012/0180968 | A1* | 7/2012 | Gupta et al. | 162/157.3 |
| 2012/0181720 | A1* | 7/2012 | Gupta et al. | 264/103 |
| 2012/0183861 | A1* | 7/2012 | Gupta et al. | 429/247 |
| 2012/0183862 | A1* | 7/2012 | Gupta et al. | 429/254 |
| 2012/0184164 | A1* | 7/2012 | Gupta et al. | 442/60 |
| 2012/0219756 | A1 | 8/2012 | Yoshida et al. | |
| 2012/0219766 | A1* | 8/2012 | Gupta et al. | 428/195.1 |
| 2012/0302120 | A1 | 11/2012 | Clark et al. | |
| 2013/0123409 | A1 | 5/2013 | Clark et al. | |
| 2013/0193086 | A1 | 8/2013 | Parker et al. | |
| 2013/0337712 | A1* | 12/2013 | Zhang et al. | 442/154 |
| 2014/0273704 | A1* | 9/2014 | Baer et al. | 442/352 |
| 2014/0311694 | A1* | 10/2014 | Clark et al. | 162/145 |
| 2014/0311695 | A1* | 10/2014 | Clark et al. | 162/145 |
| 2015/0007955 | A1 | 1/2015 | Parker et al. | |

FOREIGN PATENT DOCUMENTS

| | | | |
|---|---|---|---|
| EP | 0028909 | A1 | 11/1980 |
| EP | 0193798 | A1 | 9/1986 |
| EP | 0235820 | A1 | 9/1987 |
| EP | 0 340 763 | A1 | 11/1989 |
| EP | 0 396 771 | A1 | 11/1990 |
| EP | 0 610 894 | A1 | 8/1994 |
| EP | 0 610 897 | A1 | 8/1994 |
| EP | 0 618 317 | A1 | 10/1994 |
| EP | 0 830 466 | A1 | 3/1998 |
| EP | 0 836 656 | A1 | 4/1998 |
| EP | 0 859 073 | A1 | 8/1998 |
| EP | 0 880 909 | A1 | 12/1998 |
| EP | 0 666 344 | B1 | 9/1999 |
| EP | 1 161 576 | A1 | 12/2001 |
| EP | 1 243 675 | A1 | 9/2002 |
| EP | 0 645 480 | B1 | 11/2002 |
| EP | 0 961 847 | B1 | 12/2002 |
| EP | 1359632 | A2 | 4/2003 |
| EP | 0 935 682 | B1 | 9/2003 |
| EP | 1 416 077 | A2 | 5/2004 |
| EP | 1457591 | A1 | 9/2004 |
| EP | 0 905 292 | B1 | 10/2004 |
| EP | 1538686 | A1 | 6/2005 |
| EP | 1 550 746 | A1 | 7/2005 |
| EP | 1 322 802 | B1 | 8/2005 |
| EP | 1 314 808 | B1 | 1/2006 |
| EP | 1252219 | B1 | 8/2006 |
| EP | 1 325 184 | B1 | 9/2006 |
| EP | 1 715 089 | A2 | 10/2006 |
| EP | 1 319 095 | B1 | 11/2006 |
| EP | 1 731 634 | A | 12/2006 |
| EP | 1 149 195 | B1 | 1/2007 |
| EP | 1 412 567 | B1 | 1/2007 |
| EP | 1 404 905 | B1 | 4/2007 |
| EP | 0 842 310 | B1 | 1/2008 |
| EP | 1 894 609 | A1 | 3/2008 |
| EP | 1 903 134 | A1 | 3/2008 |
| EP | 1 938 883 | A1 | 7/2008 |
| EP | 2 082 082 | A2 | 7/2009 |
| EP | 1 516 079 | B1 | 12/2009 |
| EP | 2 135 984 | A1 | 12/2009 |
| EP | 1 224 900 | B1 | 6/2010 |
| EP | 2 243 872 | A1 | 10/2010 |
| EP | 2283796 | A1 | 2/2011 |
| EP | 2287374 | A1 | 2/2011 |
| EP | 1 620 506 | B1 | 3/2011 |
| EP | 0847263 | B2 | 3/2011 |
| EP | 2292309 | A1 | 3/2011 |
| EP | 1474555 | B1 | 4/2011 |
| EP | 2308579 | A1 | 4/2011 |
| EP | 2311542 | A1 | 4/2011 |
| EP | 2311543 | A1 | 4/2011 |
| FR | 2654674 | A1 | 5/1991 |
| FR | 2867193 | A1 | 9/2005 |
| GB | 1073640 | | 6/1967 |
| JP | 52-066719 | | 6/1977 |
| JP | 58-83046 | A | 5/1983 |
| JP | 58174625 | A | 10/1983 |
| JP | 61-047822 | | 3/1986 |
| JP | 61-296120 | A | 12/1986 |
| JP | 62-078213 | | 4/1987 |
| JP | 63-159523 | A | 7/1988 |
| JP | S63-227898 | A | 9/1988 |
| JP | 01-162825 | A | 6/1989 |
| JP | 1-272820 | A | 10/1989 |
| JP | 1-289838 | A | 11/1989 |
| JP | 02-026920 | A | 1/1990 |
| JP | 02-210092 | A | 8/1990 |
| JP | 3-16378 | B2 | 3/1991 |
| JP | H0390675 | A | 4/1991 |
| JP | 3-180587 | A | 8/1991 |
| JP | 04-057918 | A | 2/1992 |
| JP | 4327209 | A | 11/1992 |
| JP | 5-18334 | B2 | 3/1993 |
| JP | H05214649 | A | 8/1993 |
| JP | 05-263316 | | 10/1993 |
| JP | 1993-263316 | A | 10/1993 |
| JP | 6-002221 | A | 1/1994 |
| JP | 6-25396 | A | 2/1994 |
| JP | 9-77963 | A | 3/1997 |
| JP | 9-100397 | A | 4/1997 |
| JP | 9-249742 | A | 9/1997 |
| JP | 09-291472 | | 11/1997 |
| JP | 09-310230 | | 12/1997 |
| JP | 2000-95850 | | 4/2000 |
| JP | 3131100 | B2 | 1/2001 |
| JP | 2001-123335 | | 5/2001 |
| JP | 2002-151040 | A | 5/2002 |
| JP | 2003-020524 | A | 1/2003 |
| JP | 2003-253555 | A | 9/2003 |

(56) References Cited

FOREIGN PATENT DOCUMENTS

| | | | |
|---|---|---|---|
| JP | 2004-137319 | | 5/2004 |
| JP | 2004-137418 | A | 5/2004 |
| JP | 2005-002510 | | 1/2005 |
| JP | 2005-154450 | A | 6/2005 |
| JP | 2005-330612 | A | 12/2005 |
| JP | 2006-233365 | A | 9/2006 |
| JP | 2007-092235 | | 12/2007 |
| JP | 2008-127694 | A | 6/2008 |
| JP | 2010-070870 | A | 4/2010 |
| JP | 2010-255173 | A | 11/2010 |
| JP | 4648815 | B2 | 3/2011 |
| KR | 2001-0044145 | | 6/2001 |
| KR | 531939 | B1 | 11/2005 |
| KR | 2011-031744 | A | 3/2011 |
| KR | 2011-031746 | A | 3/2011 |
| RU | 2414950 | C1 | 3/2011 |
| RU | 2414960 | C1 | 3/2011 |
| TW | 230212 | B | 4/2005 |
| WO | WO 93/07197 | A1 | 4/1993 |
| WO | WO 9414885 | A1 * | 7/1994 |
| WO | WO 94/24218 | A | 10/1994 |
| WO | WO 95/03172 | A1 | 2/1995 |
| WO | WO 99/47621 | A1 | 9/1999 |
| WO | WO 99/48668 | | 9/1999 |
| WO | WO 01/66666 | A2 | 9/2001 |
| WO | WO 02/060497 | A2 | 8/2002 |
| WO | WO 03/069038 | A1 | 8/2003 |
| WO | WO 2004/067818 | A2 | 8/2004 |
| WO | WO 2004/099314 | A1 | 11/2004 |
| WO | WO 2004/113598 | A2 | 12/2004 |
| WO | WO 2005/066403 | A1 | 7/2005 |
| WO | WO 2005/103354 | A1 | 11/2005 |
| WO | WO 2005/103357 | A1 | 11/2005 |
| WO | WO 2006/001739 | A1 | 1/2006 |
| WO | WO 2006/034070 | A1 | 3/2006 |
| WO | WO 2006/052732 | A2 | 5/2006 |
| WO | WO 2006/098851 | A2 | 9/2006 |
| WO | WO 2006/107695 | A2 | 10/2006 |
| WO | WO 2007/089423 | A2 | 8/2007 |
| WO | WO 2007/112443 | A2 | 10/2007 |
| WO | WO 2008/028134 | A1 | 3/2008 |
| WO | WO 2008/085332 | A2 | 7/2008 |
| WO | WO 2009/024836 | A1 | 2/2009 |
| WO | WO 2009/051283 | A1 | 4/2009 |
| WO | WO 2009/076401 | A1 | 6/2009 |
| WO | WO 2009/088564 | A1 | 7/2009 |
| WO | WO 2009/140381 | A1 | 11/2009 |
| WO | WO 2009/152349 | A1 | 12/2009 |
| WO | WO 2010/114820 | A2 | 10/2010 |
| WO | WO 2010/117612 | A2 | 10/2010 |
| WO | WO 2010/125239 | A2 | 11/2010 |
| WO | WO 2010/140853 | A2 | 12/2010 |
| WO | WO 2011/015709 | A1 | 2/2011 |
| WO | WO 2011/018459 | A1 | 2/2011 |
| WO | WO 2011/008481 | A3 | 3/2011 |
| WO | WO 2011/027732 | A1 | 3/2011 |
| WO | WO 2011/028661 | A2 | 3/2011 |
| WO | WO 2011/034523 | A1 | 3/2011 |
| WO | WO 2011/047966 | A1 | 4/2011 |
| WO | WO 2011/049831 | A2 | 4/2011 |
| WO | WO 2011/049927 | A2 | 4/2011 |
| WO | WO 2011/052173 | A1 | 5/2011 |
| WO | WO 2011/054932 | A1 | 5/2011 |
| WO | WO 2011/062761 | A1 | 5/2011 |
| WO | WO 2011/063372 | A2 | 5/2011 |
| WO | WO 2011/066224 | A2 | 6/2011 |
| WO | WO 2011/070233 | A1 | 6/2011 |
| WO | WO 2011/104427 | A1 | 9/2011 |
| WO | WO 2011/157892 | A1 | 12/2011 |
| WO | WO 2012/054669 | A1 | 4/2012 |
| WO | WO 2012/138552 | A2 | 10/2012 |
| WO | WO 2013/116067 | A2 | 8/2013 |
| WO | WO 201417219 | * | 10/2014 |

OTHER PUBLICATIONS

U.S. Appl. No. 61/172,257, filed Apr. 24, 2009, Rakesh Kumar Gupta, et al.

Lydall Filtration and Separation; "Nonwoven Liquid Filtration Media Construction and Performance"; Accessed from the web: http://www.lydallfiltration.com/tech/documents/Nonwovenliquidfiltration.pdf.

PCT International Search Report dated Jul. 3, 2009 for International Application No. PCT/US2009/001717.

PCT International Search Report dated Feb. 28, 2012 for International Application No. PCT/US2011/056990.

PCT International Search Report dated Feb. 28, 2012 for International Application No. PCT/US2011/056994.

PCT International Search Report dated Feb. 14, 2012 for International Application No. PCT/US2011/056989.

PCT International Search Report dated Feb. 28, 2012 for International Application No. PCT/US2011/056995.

PCT International Search Report dated Feb. 28, 2012 for International Application No. PCT/US2011/056991.

PCT International Search Report dated Feb. 28, 2012 for International Application No. PCT/US2011/057002.

USPTO Notice of Allowance dated Nov. 9, 2009 for copending U.S. Appl. No. 11/648,955.

USPTO Office Action dated Dec. 24, 2009 for copending U.S. Appl. No. 11/344,320.

USPTO Office Action dated Dec. 22, 2009 for copending U.S. Appl. No. 11/204,868.

USPTO Notice of Allowance dated Jun. 9, 2010 for copending U.S. Appl. No. 11/344,320.

USPTO Notice of Allowance dated Jun. 9, 2010 for copending U.S. Appl. No. 11/204,868.

USPTO Office Action dated Aug. 6, 2010 for copending U.S. Appl. No. 11/648,953.

USPTO Office Action dated Dec. 21, 2004 for U.S. Appl. No. 10/850,548, published as 2004-0258910.

USPTO Notice of Allowance dated Jun. 8, 2005 for U.S. Appl. No. 10/850,548.

ASTM D6340-98 (Reapproved 2007) ASTM International, copyright Sep. 15, 2010.

PCT International Search Report dated Feb. 7, 2005 for International Application No. PCT/US2004/018682.

Copending U.S. Appl. No. 12/765,461, filed Apr. 22, 2010, Rakesh Kumar Gupta, et al.

Smook, G.A., "Handbook for Pulp and Paper Technologist", Angus Wilde Publications, 2nd Ed., 1992, pp. 194-195, 211-212.

PCT International Search Report dated Dec. 30, 2008 for International Application No. PCT/US2007/025770.

USPTO Office Action dated Sep. 27, 2010 for U.S. Appl. No. 12/199,304.

USPTO Notice of Allowance dated Sep. 30, 2010 for U.S. Appl. No. 11/344,320.

USPTO Notice of Allowance dated Oct. 14, 2010 for U.S. Appl. No. 11/204,868.

Copending U.S. Appl. No. 12/909,574, filed Oct. 21, 2010, Rakesh Kumar Gupta, et al.

Copending U.S. Appl. No. 12/966,483, filed Dec. 13, 2010, William Alston Haile, et al.

Copending U.S. Appl. No. 12/966,487, filed Dec. 13, 2010, William Alston Haile, et al.

Copending U.S. Appl. No. 12/966,494, filed Dec. 13, 2010, William Alston Haile, et al.

Copending U.S. Appl. No. 12/966,502, filed Dec. 13, 2010, William Alston Haile, et al.

Copending U.S. Appl. No. 12/966,507, filed Dec. 13, 2010, William Alston Haile, et al.

Copending U.S. Appl. No. 12/966,512, filed Dec. 13, 2010, William Alston Haile, et al.

Copending U.S. Appl. No. 12/966,518, filed Dec. 13, 2010, William Alston Haile, et al.

Copending U.S. Appl. No. 12/966,521, filed Dec. 13, 2010, William Alston Haile, et al.

(56) References Cited

OTHER PUBLICATIONS

Copending U.S. Appl. No. 12/975,443, filed Dec. 22, 2010, Rakesh Kumar Gupta, et al.
Copending U.S. Appl. No. 12/975,447, filed Dec. 22, 2010, Rakesh Kumar Gupta, et al.
Copending U.S. Appl. No. 12/975,450, filed Dec. 22, 2010, Rakesh Kumar Gupta, et al.
Copending U.S. Appl. No. 12/975,452, filed Dec. 22, 2010, Rakesh Kumar Gupta, et al.
Copending U.S. Appl. No. 12/975,456, filed Dec. 22, 2010, Rakesh Kumar Gupta, et al.
Copending U.S. Appl. No. 12/975,459, filed Dec. 22, 2010, Rakesh Kumar Gupta, et al.
Copending U.S. Appl. No. 12/975,463, filed Dec. 22, 2010, Rakesh Kumar Gupta, et al.
Copending U.S. Appl. No. 12/975,482, filed Dec. 22, 2010, Rakesh Kumar Gupta, et al.
Copending U.S. Appl. No. 12/975,484, filed Dec. 22, 2010, Rakesh Kumar Gupta, et al.
Copending U.S. Appl. No. 12/975,487, filed Dec. 22, 2010, Rakesh Kumar Gupta, et al.
Copending U.S. Appl. No. 12/981,950, filed Dec. 30, 2010, William Alston Haile, et al.
Copending U.S. Appl. No. 12/981,960, filed Dec. 30, 2010, William Alston Haile, et al.
Copending U.S. Appl. No. 12/981,982, filed Dec. 30, 2010, William Alston Haile, et al.
Copending U.S. Appl. No. 12/982,001, filed Dec. 30, 2010, William Alston Haile, et al.
New copending U.S. Appl. No. 13/352,362, filed Jan. 18, 2012, Rakesh Kumar Gupta et al.
USPTO Notice of Allowance dated Apr. 4, 2011 for copending U.S. Appl. No. 12/199,304.
USPTO Office Action dated Mar. 18, 2011 for copending U.S. Appl. No. 11/648,953.
USPTO Office Action dated Apr. 6, 2011 for copending U.S. Appl. No. 12/975,487.
USPTO Office Action dated Apr. 4, 2011 for copending U.S. Appl. No. 12/981,960.
USPTO Office Action dated Apr. 6, 2011 for copending U.S. Appl. No. 12/975,482.
USPTO Office Action dated Jun. 7, 2011 for copending U.S. Appl. No. 12/982,001.
USPTO Office Action dated Jun. 9, 2011 for copending U.S. Appl. No. 12/975,459.
USPTO Office Action dated May 27, 2011 for copending U.S. Appl. No. 12/975,452.
USPTO Office Action dated Jun. 23, 2011 for copending U.S. Appl. No. 12/966,487.
USPTO Office Action dated Jun. 23, 2011 for copending U.S. Appl. No. 12/966,502.
USPTO Office Action dated May 10, 2012 for copending U.S. Appl. No. 12/966,521.
USPTO Office Action dated Mar. 16, 2012 for copending U.S. Appl. No. 12/966,483.
USPTO Notice of Allowance dated Apr. 2, 2012 for copending U.S. Appl. No. 12/966,502.
USPTO Office Action dated Jun 23, 2011 for copending U.S. Appl. No. 12/975,443.
USPTO Notice of Allowance dated Jul. 18, 2011 for copending U.S. Appl. No. 12/199,304.
USPTO Office Action dated Aug. 10, 2011 for copending U.S. Appl. No. 12/966,512.
USPTO Office Action dated Sep. 15, 2011 for copending U.S. Appl. No. 11/648,953.
USPTO Office Action dated May 3, 2012 for copending U.S. Appl. No. 12/765,461.
USPTO Office Action dated Sep. 8, 2011 for copending U.S. Appl. No. 12/966,494.
USPTO Notice of Allowance dated Apr. 18, 2012 for copending U.S. Appl. No. 12/966,494.
USPTO Office Action dated Sep. 26, 2011 for copending U.S. Appl. No. 12/966,507.
USPTO Office Action dated Apr. 23, 2012 for copending U.S. Appl. No. 12/966,507.
USPTO Office Action dated Sep. 1, 2011 for copending U.S. Appl. No. 12/975,450.
USPTO Office Action dated Aug. 24, 2011 for copending U.S. Appl. No. 12/975,456.
USPTO Office Action dated Apr. 19, 2012 for copending U.S. Appl. No. 12/975,456.
USPTO Office Action dated Sep. 27, 2011 for copending U.S. Appl. No. 12/975,463.
USPTO Office Action dated Apr. 19, 2012 for copending U.S. Appl. No. 12/975,463.
USPTO Office Action dated Aug. 31, 2011 for copending U.S. Appl. No. 13/053,615.
Coons, R., "Eastman Chemical Core Focus Delivers Value," Chemical Week, Aug. 15-22, 2011, pp. 19-22.
USPTO Office Action dated Nov. 10, 2011 for copending U.S. Appl. No. 12/981,950.
USPTO Office Action dated Jan. 25, 2012 for copending U.S. Appl. No. 12/981,982.
USPTO Notice of Allowance dated Jan. 3, 2012 for copending U.S. Appl. No. 12/975,487.
USPTO Notice of Allowance dated Dec. 23, 2011 for copending U.S. Appl. No. 12/975,452.
USPTO Notice of Allowance dated Apr. 2, 2012 for copending U.S. Appl. No. 12/975,452.
USPTO Notice of Allowance dated Dec. 8, 2011 for copending U.S. Appl. No. 12/981,960.
USPTO Notice of Allowance dated Mar. 15, 2012 for copending U.S. Appl. No. 12/981,960.
USPTO Notice of Allowance dated Dec. 13, 2011 for copending U.S. Appl. No. 12/966,487.
USPTO Notice of Allowance dated Apr. 13, 2012 for copending U.S. Appl. No. 12/966,487.
USPTO Notice of Allowance dated Dec. 12, 2011 for copending U.S. Appl. No. 12/966,502.
USPTO Notice of Allowance dated Dec. 9, 2011 for copending U.S. Appl. No. 12/966,512.
USPTO Notice of Allowance dated Mar. 21, 2012 for copending U.S. Appl. No. 12/966,512.
USPTO Notice of Allowance dated Jan. 9, 2012 for copending U.S. Appl. No. 12/975,482.
USPTO Office Action dated Nov. 10, 2011 for copending U.S. Appl. No. 12/975,484.
USPTO Notice of Allowance dated Apr. 18, 2012 for copending U.S. Appl. No. 12/975,484.
U.S. Appl. No. 61/405,306, filed Oct. 21, 2010, Rakesh Kumar Gupta, et al.
U.S. Appl. No. 61/405,312, filed Oct. 21, 2010, Rakesh Kumar Gupta, et al.
U.S. Appl. No. 61/588,744, filed Nov. 11, 2011, Clark et al.
U.S. Appl. No. 61/592,854, filed Jan. 31, 2012, Parker et al.
U.S. Appl. No. 61/592,867, filed Jan. 31, 2012, Parker et al.
U.S. Appl. No. 61/592,876, filed Jan. 31, 2012, Parker et al.
U.S. Appl. No. 61/592,917, filed Jan. 31, 2012, Parker et al.
U.S. Appl. No. 61/592,974, filed Jan. 31, 2012, Parker et al.
New copending U.S. Appl. No. 13/273,692, filed Oct. 14, 2011, Rakesh Kumar Gupta, et al.
New copending U.S. Appl. No. 13/273,648, filed Oct. 14, 2011, Rakesh Kumar Gupta, et al.
New copending U.S. Appl. No. 13/273,710, filed Oct. 14, 2011, Rakesh Kumar Gupta, et al.
New copending U.S. Appl. No. 13/273,720, filed Oct. 14, 20,11, Rakesh Kumar Gupta, et al.
New copending U.S. Appl. No. 13/273,929, filed Oct. 14, 2011, Rakesh Kumar Gupta, et al.
New copending U.S. Appl. No. 13/273,937, filed Oct. 14, 2011, Rakesh Kumar Gupta, et al.

(56) References Cited

OTHER PUBLICATIONS

New copending U.S. Appl. No. 13/273,727, filed Oct. 14, 2011, Rakesh Kumar Gupta, et al.
New copending U.S. Appl. No. 13/273,737, filed Oct. 14, 2011, Rakesh Kumar Gupta, et al.
New copending U.S. Appl. No. 13/273,745, filed Oct. 14, 2011, Rakesh Kumar Gupta, et al.
New copending U.S. Appl. No. 13/273,749, filed Oct. 14, 2011, Rakesh Kumar Gupta, et al.
New copending U.S. Appl. No. 13/433,812, filed Mar. 29, 2012, Clark et al.
New copending U.S. Appl. No. 13/433,854, filed Mar. 29, 2012, Clark et al.
Investigation of the utility of islands-in-the-stream bicomponent fiber technology in the spunbound process. Fedorova, Dec. 2006 (retrieved on Mar. 20, 2012 from internet) pp. 22-23, 74 <URL: http://repository.lib.ncsu.ed/ir/bitstream/1840.16/5145/1/etd.pdf>.
"Choosing the Proper Short Cut Fiber", technical data sheet, MiniFibers, Inc., [online] pp. 1-2, 2006, [retrieved on Feb. 15, 2006], Retrieved from the Inernet: <URL: htts://www.minifibers.com/Literature/choosing_fiber.htm>.
USPTO Notice of Allowance dated Feb. 7, 2012 for copending U.S. Appl. No. 12/975,459.
USPTO Notice of Allowance dated Feb. 17, 2012 for copending U.S. Appl. No. 12/982,001.
USPTO Notice of Allowance dated Feb. 21, 2012 for copending U.S. Appl. No. 12/975,450.
USPTO Notice of Allowance dated Feb. 23, 2012 for copending U.S. Appl. No. 13/053,615.
USPTO Office Action dated Nov. 10, 2011 for copending U.S. Appl. No. 12/975,447.
USPTO Office Action dated Mar. 2, 2012 for copending U.S. Appl. No. 12/966,518.
Keith, James M., "Dispersions fo Synthetic Fibers in Wet-Lay Nonwovens". MiniFIBERS, Inc., originally published in the Tappi Journal, vol. 77, No. 6, Jun. 1994, entire document.
USPTO Office Action dated Jan. 25, 2008 for copending U.S. Appl. No. 11/343,955.
USPTO Office Action dated Oct. 10, 2008 for copending U.S. Appl. No. 11/343,955.
USPTO Notice of Allowance dated Mar. 9, 2009 for copending U.S. Appl. No. 11/343,955.
USPTO Notice of Allowance dated Aug. 7, 2009 for copending U.S. Appl. No. 11/343,955.
Copending U.S. Appl. No. 11/648,955, filed Jan. 3, 2007, Rakesh Kumar Gupta, et al.
USPTO Office Action dated Jan. 30, 2012 for copending U.S. Appl. No. 12/975,443.
USPTO Office Action dated May 21, 2012 for copending U.S. Appl. No. 12/981,982.
USPTO Office Action dated Oct. 4, 2012 for copending U.S. Appl. No. 13/273,745.
USPTO Office Action dated Nov. 26, 2012 for copending U.S. Appl. No. 13/273,648.
USPTO Office Action dated Nov. 20, 2012 for copending U.S. Appl. No. 13/273,710.
USPTO Office Action dated Nov. 7, 2012 for copending U.S. Appl. No. 13/273,720.
USPTO Notice of Allowance dated Jun. 4, 2012 for copending U.S. Appl. No. 12/981,960.
USPTO Notice of Allowance dated Jun. 7, 2012 for copending U.S. Appl. No. 12/966,487.
USPTO Notice of Allowance dated Jun. 11, 2012 for copending U.S. Appl. No. 12/966,512.
USPTO Notice of Allowance dated Jun. 13, 2012 for copending U.S. Appl. No. 12/966,502.
USPTO Notice of Allowance dated Jun. 29, 2012 for copending U.S. Appl. No. 12/981,950.
USPTO Notice of Allowance dated Jul. 3, 2012 for copending U.S. Appl. No. 12/974,452.
USPTO Office Action dated Jul. 5, 2012 for copending U.S. Appl. No. 12/966,507.
USPTO Notice of Allowance dated Jul. 6, 2012 for copending U.S. Appl. No. 12/975,456.
USPTO Notice of Allowance dated Jul. 27, 2012 for copending U.S. Appl. No. 12/981,982.
USPTO Office Action dated Aug. 14, 2012 for copending U.S. Appl. No. 12/199,304.
USPTO Notice of Allowance dated Jul. 19, 2012 for copending U.S. Appl. No. 12/981,950.
USPTO Notice of Allowance dated Aug. 10, 2012 for copending U.S. Appl. No. 12/975,487.
USPTO Notice of Allowance dated Jul. 31, 2012 for copending U.S. Appl. No. 12/975,456.
USPTO Office Action dated Aug. 27, 2012 for copending U.S. Appl. No. 12/975,443.
USPTO Office Action dated Aug. 28, 2012 for copending U.S. Appl. No. 12/975,447.
USPTO Notice of Allowance dated Oct. 11, 2012 for copending U.S. Appl. No. 12/975,487.
USPTO Notice of Allowance dated Oct. 22, 2012 for copending U.S. Appl. No. 12/966,518.
USPTO Notice of Allowance dated Nov. 2, 2012 for copending U.S. Appl. No. 12/966,507.
USPTO Office Action dated Nov. 2, 2012 for copending U.S. Appl. No. 13/273,692.
New co-pending U.S. Appl. No. 13/671,682, filed Nov. 8, 2012.
New co-pending U.S. Appl. No. 13/687,466, filed Nov. 28, 2012.
New co-pending U.S. Appl. No. 13/687,472, filed Nov. 28, 2012.
New co-pending U.S. Appl. No. 13/687,478, filed Nov. 28, 2012.
New co-pending U.S. Appl. No. 13/687,493, filed Nov. 28, 2012.
New co-pending U.S. Appl. No. 13/687,505, filed Nov. 28, 2012.
USPTO Office Action dated Dec. 4, 2012 for copending U.S. Appl. No. 13/273,749.
USPTO Notice of Allowance dated Dec. 10, 2012 for copending U.S. Appl. No. 12/966,521.
USPTO Notice of Allowance dated Jan. 8, 2013 for copending U.S. Appl. No. 12/966,483.
USPTO Notice of Allowance dated Jan. 10, 2013 for copending U.S. Appl. No. 12/975,447.
USPTO Notice of Allowance dated Jan. 15, 2013 for copending U.S. Appl. No. 12/975,463.
PCT International Search Report dated Jan. 23, 2013 for International Application No. PCT/US2012/064272.
USPTO Notice of Allowance dated Jan. 25, 2013 for copending U.S. Appl. No. 12/966,521.
USPTO Notice of Allowance dated Jan. 28, 2013 for copending U.S. Appl. No. 12/765,461.
USPTO Notice of Allowance dated Mar. 21, 2013 for copending U.S. Appl. No. 12/975,482.
USPTO Notice of Allowance dated Mar. 22, 2013 for copending U.S. Appl. No. 12/966,518.
PCT International Search Report dated Mar. 29, 2013 for International Application No. PCT/US2013/022830.
PCT International Search Report dated Mar. 27, 2013 for International Application No. PCT/US2013/022832.
PCT International Search Report dated Mar. 27, 2013 for International Application No. PCT/US2013/022834.
PCT International Search Report dated Mar. 27, 2013 for International Application No. PCT/US2013/022835.
PCT International Search Report dated Mar. 27, 2013 for International Application No. PCT/US2013/022838.
USPTO Notice of Allowance dated Mar. 28, 2013 for copending U.S. Appl. No. 12/966,521.
PCT International Search Report dated Mar. 29, 2013 for International Application No. PCT/US2013/021804.
USPTO Notice of Allowance dated Apr. 8, 2013 for copending U.S. Appl. No. 12/966,483.
USPTO Notice of Allowance dated Apr. 16, 2013 for copending U.S. Appl. No. 12/765,461.
USPTO Notice of Allowance dated Apr. 24, 2013 for copending U.S. Appl. No. 12/199,304.

(56) References Cited

OTHER PUBLICATIONS

USPTO Notice of Allowance dated May 1, 2013 for copending U.S. Appl. No. 12/975,482.
CFF Acrylic Pulps/Fibrillated Fibers, Datasheet [Online], Sterling Fibers, Feb. 7, 2011 [retrieved Mar. 4, 2013], <url: http:www.sterlingfibers.com/wetlaid.htm>.
USPTO Office Action dated Jun. 19, 2013 for copending U.S. Appl. No. 12/909,574.
New co-pending U.S. Appl. No. 13/941,816, filed Jul. 15, 2013.
USPTO Office Action dated Jul. 19, 2013 for copending U.S. Appl. No. 13/433,854.
USPTO Office Action dated Jul. 22, 2013 for copending U.S. Appl. No. 13/433,812.
USPTO Office Action dated Jul. 30, 2013 for copending U.S. Appl. No. 13/273,749.
USPTO Office Action dated Aug. 19, 2013 for copending U.S. Appl. No. 13/273,745.
Pettersson, Patrick, "Fluid Flow in Wood Fiber Networks," Lulea University of Technology, 2006:34, ISSN: 1402-1757.
USPTO Notice of Allowance dated Sep. 5, 2013 for copending U.S. Appl. No. 12/966,507.
USPTO Office Action dated Sep. 6, 2013 for copending U.S. Appl. No. 12/966,494.
USPTO Office Action dated Sep. 20, 2013 for copending U.S. Appl. No. 13/687,472.
USPTO Office Action dated Sep. 20, 2013 for copending U.S. Appl. No. 13/687,478.
USPTO Office Action dated Sep. 20, 2013 for copending U.S. Appl. No. 13/687,505.
USPTO Office Action dated Sep. 24, 2013 for copending U.S. Appl. No. 13/687,466.
USPTO Office Action dated Sep. 25, 2013 for copending U.S. Appl. No. 13/273,692.
USPTO Office Action dated Sep. 25, 2013 for copending U.S. Appl. No. 13/273,648.
USPTO Office Action dated Sep. 25, 2013 for copending U.S. Appl. No. 13/687,493.
USPTO Office Action dated Oct. 9, 2013 for copending U.S. Appl. No. 13/944,458.
USPTO Office Action dated Dec. 3, 2013 for copending U.S. Appl. No. 13/273,937.
USPTO Notice of Allowance dated Dec. 4, 2013 for copending U.S. Appl. No. 12/975,484.
New Co-pending U.S. Appl. No. 14/108,389, filed Dec. 17, 2013.
USPTO Office Action dated Dec. 31, 2013 for copending U.S. Appl. No. 13/352,362.
USPTO Notice of Allowance dated Feb. 4, 2014 for copending U.S. Appl. No. 12/975,484.
USPTO Office Action dated Feb. 10, 2014 for copending U.S. Appl. No. 13/433,854.
Extended European Search Report dated Feb. 25, 2014 for Application No./Patent No. 11835114.7-1303 / 2630297 PCT/US2011056997.
USPTO Office Action dated Mar. 7, 2014 for copending U.S. Appl. No. 12/966,494.
USPTO Office Action dated Mar. 13, 2014 for copending U.S. Appl. No. 12/909,574.
USPTO Office Action dated Mar. 25, 2014 for copending U.S. Appl. No. 13/273,727.
New Co-pending U.S. Appl. No. No. 14/249,858, filed Apr. 10, 2014.
USPTO Office Action dated May 8, 2014 for copending U.S. Appl. No. 13/273,692.
USPTO Office Action dated May 8, 2014 for copending U.S. Appl. No. 13/273,648.
USPTO Notice of Allowance dated May 8, 2014 for copending U.S. Appl. No. 13/687,478.
USPTO Notice of Allowance dated May 13, 2014 for copending U.S. Appl. No. 13/687,472.
USPTO Notice of Allowance dated May 14, 2014 for copending U.S. Appl. No. 13/687,466.
USPTO Notice of Allowance dated May 23, 2014 for copending U.S. Appl. No. 13/687,493.
USPTO Office Action dated Jun. 19, 2014 for copending U.S. Appl. No. 13/671,682.
USPTO Notice of Allowance dated Jun. 19, 2014 for copending U.S. Appl. No. 13/687,505.
USPTO Office Action dated Jul. 15, 2014 for copending U.S. Appl. No. 13/273,737.
USPTO Office Action dated Jul. 18, 2014 for copending U.S. Appl. No. 13/944,458.
USPTO Office Action dated Jul. 31, 2014 for co-pending U.S. Appl. No. 13/273,937.
USPTO Office Action dated Aug. 4, 2014 for co-pending U.S. Appl. No. 13/352,362.
Extended European Search Report dated Aug. 6, 2014 for Application No./Patent No. 11835104.8-1308 / 2630284 PCT/US2011056984.
Extended European Search Report dated Aug. 6, 2014 for Application No./Patent No. 11835106.3-1308 / 2629950 PCT/US2011056986.
Extended European Search Report dated Aug. 6, 2014 for Application No./Patent No. 11835107.1-1308 / 2630288 PCT/US2011056987.
PCT International Search Report dated Aug. 28, 2014 for International Application No. PCT/US2014/033771.
New Co-pending U.S. Appl. No. 14/490,084, filed Sep. 18, 2014.
USPTO Office Action dated Sep. 26, 2014 for co-pending U.S. Appl. No. 13/273,727.
USPTO Office Action dated Nov. 21, 2014 for co-pending U.S. Appl. No. 14/249,858.
USPTO Office Action dated Dec. 4, 2014 for co-pending U.S. Appl. No. 14/490,084.
USPTO Office Action dated Dec. 15, 2014 for co-pending U.S. Appl. No. 13/433,854.
USPTO Office Action dated Feb. 11, 2015 for co-pending U.S. Appl. No. 13/273,692.
USPTO Office Action dated Feb. 11, 2105 for co-pending U.S. Appl. No. 13/273,648.
Notification of Transmittal of the International Search Report and the Written Opinion of the International Search Report and the Written Opinion of the International Searching Authority, or the Declaration—International Application No. PCT/US2014/069888 with a Mailing Date of Mar. 2, 2015.
USPTO Office Action dated May 4, 2015 for co-pending U.S. Appl. No. 13/352,362.
USPTO Office Action dated Jul. 9, 2015 for co-pending U.S. Appl. No. 13/671,682.
USPTO Notice of Allowance dated Jul. 13, 2015 for co-pending U.S. Appl. No. 14/490,084.
USPTO Office Action dated Jul. 23, 2015 for co-pending U.S. Appl. No. 14/249,858.
Extended European Search Report dated Jul. 20, 2015 for Application No./Patent No. 12847445.9-1306 / 2776615 PCT/US2012064272.
USPTO Office Action dated Aug. 28, 2015 for co-pending U.S. Appl. No. 13/273,692.
USPTO Office Action dated Aug. 28, 2015 for co-pending U.S. Appl. No. 13/276,648.
USPTO Office Action dated Sep. 11, 2015 for co-pending U.S. Appl. No. 13/273,737.
USPTO Office Action dated Sep. 16, 2015 for co-pending U.S. Appl. No. 13/273,929.
USPTO Office Action dated Sep. 17, 2015 for co-pending U.S. Appl. No. 13/433,854.
USPTO Office Action dated Sep. 29, 2015 for co-pending U.S. Appl. No. 13/941,816.
USPTO Office Action dated Sep. 30, 2015 for co-pending U.S. Appl. No. 13/273,727.
USPTO Office Action dated Oct. 26, 2015 for co-pending U.S. Appl. No. 14/108,390.

(56) References Cited

OTHER PUBLICATIONS

USPTO Office Action dated Nov. 2, 2015 for co-pending U.S. Appl. No. 12/909,574.
USPTO Notice of Allowance dated Nov. 13, 2015 for co-pending U.S. Appl. No. 13/273,937.
USPTO Notice of Allowance dated Feb. 18, 2016 for co-pending U.S. Appl. No. 14/249,858.
USPTO Office Action dated Mar. 17, 2016 for co-pending U.S. Appl. No. 13/352,362.
USPTO Office Action dated Mar. 23, 2016 for co-pending U.S. Appl. No. 14/108,389.
USPTO Office Action dated Mar. 28, 2016 for co-pending U.S. Appl. No. 13/273,929.
USPTO Office Action dated Mar. 30, 2016 for co-pending U.S. Appl. No. 13/273,737.
USPTO Office Action dated May 25, 2016 for co-pending U.S. Appl. No. 14/108,390.
USPTO Office Action dated Jun. 13, 2016 for co-pending U.S. Appl. No. 13/433,854.
USPTO Office Action dated Aug. 26, 2016 for co-pending U.S. Appl. No. 13/273,648.
USPTO Office Action dated Aug. 26, 2016 for co-pending U.S. Appl. No. 13/273,692.

* cited by examiner

Figure 1
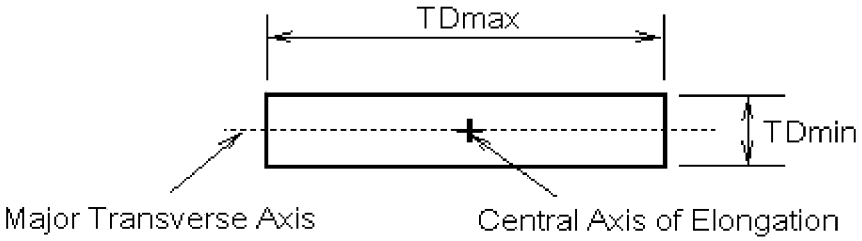
*FIG. 1a*
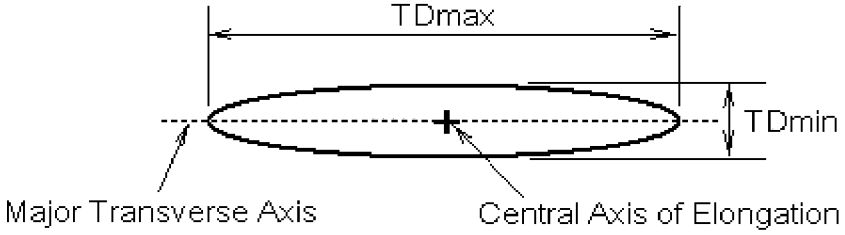
*FIG. 1b*
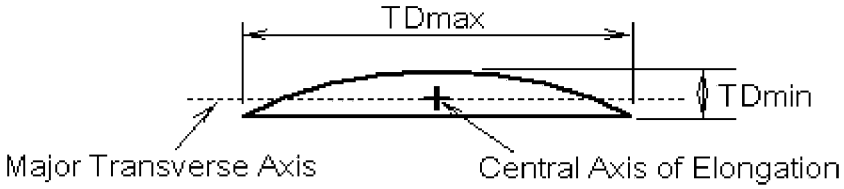
*FIG. 1c*

PROCESS FOR MAKING PAPER AND NONWOVEN ARTICLES COMPRISING SYNTHETIC MICROFIBER BINDERS

FIELD OF THE INVENTION

The present invention relates to paper and nonwoven articles comprising synthetic binder microfibers. The present invention also relates to the process of making paper and nonwoven articles comprising synthetic microfiber binders.

BACKGROUND OF THE INVENTION

In wet-laid nonwovens, it is necessary to bond together the relatively short fibers which constitute the nonwoven in order for the resulting web to have any significant strength. Generally, liquid binders and/or binder fibers are utilized for this purpose. In the case of liquid binders, a polymer solution or dispersion (e.g. latex) is applied to the nonwoven web and subsequently dried. While significant strength can be achieved through this method, there are issues which it can create. The first of these is that the liquid binder requires additional process steps in its application. Specifically, the binder solution/dispersion must be applied in a manner to yield a uniform distribution of the binder polymer in the nonwoven sheet. Wet-laid nonwovens can often include fibers with wide-ranging wettability to such liquid materials (e.g. cellulosic versus synthetic fibers) such that uniform application of the liquid binder can prove a challenge. Also, once applied, the liquid binder must be dried in order for the nonwoven manufacture to be complete. There is not only an energy expenditure required by this process (high heat of vaporization for water) but non-uniform binder levels which may be present at the nonwoven surface can result in sticking of the web to high temperature drying cans which are used in this process Binder fibers, on the other hand, are fiber materials which can be readily combined with other fibers in a wet-laid furnish but which differ somewhat from typical "structural" fibers in that they can be thermally-activated or softened at a temperature which is lower than the softening temperature of the other fibers present in the nonwoven. Current binder fibers suffer from the fact that they can typically be rather large (approximately 10-20 microns) compared to other fibrous materials present in the sheet. This larger size can result in rather significant adverse changes to the pore size/porosity of the nonwoven media. In addition, mono-component binder fibers (e.g. polyvinyl alcohol) at these relatively large diameters have low surface-to-volume ratios which can result in the melted polymer flowing and filling nonwoven pores much in the way that liquid binders do.

As a partial solution to this problem, core-sheath binder fibers are often employed. In a core-sheath binder fiber, the sheath polymer has a melting point that is lower (typically by >20° C.) than that of the core polymer. The result is that at temperatures above the sheath melting point but below the core melting point, the sheath bonds to other fibers present in the nonwoven web while the core allows the core-sheath binder fiber to maintain a largely fibrous state, such that, unlike the aforementioned polyvinyl alcohol fibers, the pores of the nonwoven are less likely to be blocked. However, core-sheath binder fibers are still rather large fibers which can significantly increase the average pore size of a nonwoven web.

There is a need in the paper and nonwoven industry for a binder fiber which is (1) sufficiently small not to adversely increase the pore size/porosity of a nonwoven (particularly at utilization rates which would impart high strength), and (2) capable of maintaining a fibrous morphology after thermally bonding with other fibers in the nonwoven web (i.e. after it melts).

SUMMARY

In one embodiment of the present invention, there is provided a paper or nonwoven article comprising a nonwoven web layer, wherein said nonwoven web layer comprises a plurality of fibers and a plurality of binder microfibers, wherein the binder microfibers comprise a water non-dispersible, synthetic polymer; wherein said binder microfibers have a length of less than 25 millimeters and a fineness of less than 0.5 d/f; and wherein said binder microfibers have a melting temperature that is less than the melting temperature of the fibers.

In another embodiment of the invention, there is provided a process of making a paper or nonwoven article. The process comprises:

a) providing a fiber furnish comprising a plurality of fibers and a plurality of binder microfibers, wherein the binder fibers comprise a water non-dispersible, synthetic polymer; wherein the binder fibers have a length of less than 25 millimeters and a fineness of less than 0.5 d/f; and wherein the binder microfibers have a melting temperature that is less than the melting temperature of said fibers;

b) routing said fiber furnish to a wet-laid nonwoven process to produce at least one wet-laid nonwoven web layer;

c) removing water from said wet-laid nonwoven web layer; and d) thermally bonding said wet-laid nonwoven web layer after step (c); wherein said thermal bonding is conducted at a temperature such that the surfaces of said binder microfibers at least partially melt without causing said fibers to melt thereby bonding the binder microfibers to said fibers to produce the paper or nonwoven article.

BRIEF DESCRIPTION OF THE FIGURES

Embodiments of the present invention are described herein with reference to the following drawing figures, wherein:

FIGS. 1*a*, 1*b*, and 1*c* are cross-sectional views of three differently-configured fibers, particularly illustrating how various measurements relating to the size and shape of the fibers are determined;

DETAILED DESCRIPTION

Figure 2:
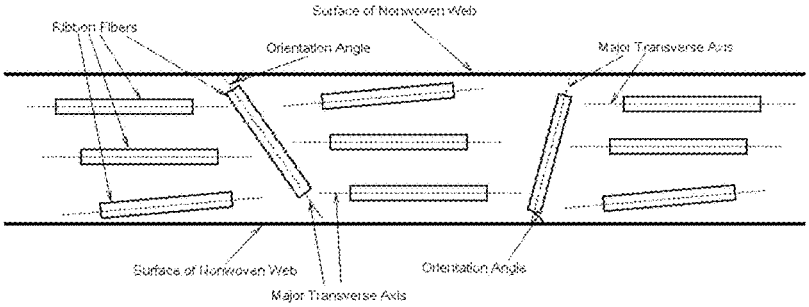
FIG. 2 is a cross-sectional view of nonwoven web containing ribbon fibers, particularly illustrating the orientation of the ribbon fibers contained therein.
Figure 3A:
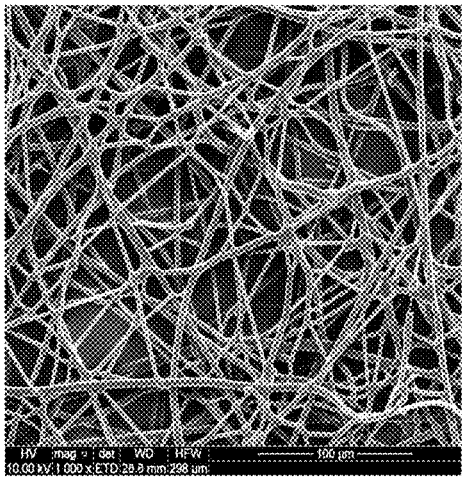
FIGS. 3*a* and 3*b* are scanning electron micrographs of the handsheet of Example 14.
Figure 3B:
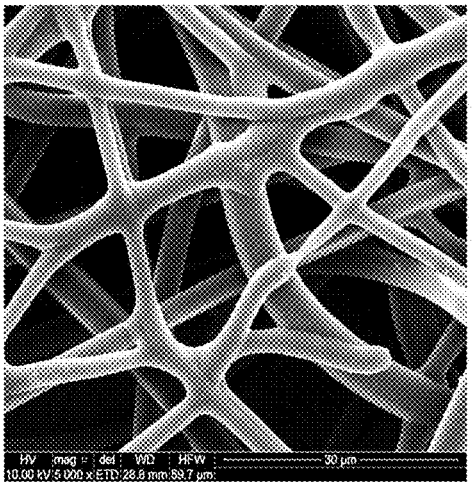

A paper or nonwoven article is provided comprising at least one nonwoven web layer, wherein the nonwoven web layer comprises a plurality of fibers and a plurality of binder microfibers, wherein the binder microfibers comprise a water non-dispersible, synthetic polymer; wherein said binder microfibers have a length of less than 25 millimeters and a fineness of less than 0.5 d/f; and wherein the binder microfibers have a melting temperature that is less than the melting temperature of the other fibers in the nonwoven web layer.

The binder microfibers of this invention are utilized as binders to hold the nonwoven web layer together and are considerably smaller than existing binder fibers. The result is that these inventive binder microfibers are much more uniformly distributed within the nonwoven web thereby resulting in significant strength improvements. Also, the high surface-to-volume characteristics of the thermally bondable, binder microfibers results in very high adhesion levels on melting without significant polymeric flow into the pores of the nonwoven web. The result is that even very well bonded nonwovens articles and/or paper (e.g. with very high levels of binder microfiber) maintain a largely open fibrous structure. The much finer diameter of these inventive binder microfibers also allows for much finer pore sizes within the nonwoven web than would be observed when using currently available binder fibers, whether monocomponent or core-sheath in cross-section.

The term "microfiber," as used herein, is intended to denote a fiber having a minimum transverse dimension that is less than 5 microns. As used herein, "minimum transverse dimension" denotes the minimum dimension of a fiber measured perpendicular to the axis of elongation of the fiber by an external caliper method. As used herein, "external caliper method" denotes a method of measuring an outer dimension of a fiber where the measured dimension is the distance separating two coplanar parallel lines between which the fiber is located and where each of the parallel lines touches the external surface of the fiber on generally opposite sides of the fiber. FIGS. 1*a*, 1*b*, and 1*c* depict how these dimensions may be measured in various fiber cross-sections. In FIGS. 1*a*, 1*a*, and 1*c*, "TDmin" is the minimum transverse dimension and "TDmax" is the maximum transverse dimension.

The attributes provided to the nonwoven web layer by the binder microfibers include improvements in strength, uniformity, and pore size/porosity control relative to nonwovens which comprise binder materials (both liquid and fiber) described in the art.

In one embodiment of the invention, a process is provided for producing a paper and/or a nonwoven article. The process comprises:

a) providing a fiber furnish comprising a plurality of fibers and a plurality of binder microfibers, wherein the binder microfibers comprise a water non-dispersible, synthetic polymer; wherein the binder microfibers have a length of less than 25 millimeters and a fineness of less than 0.5 d/f; and wherein the binder microfibers have a melting temperature that is less than the melting temperature of the fibers;

b) routing the fiber furnish to a wet-laid nonwoven process to produce at least one wet-laid nonwoven web layer;

c) removing water from the wet-laid nonwoven web layer; and d) thermally bonding the wet-laid nonwoven web layer after step (c); wherein said thermal bonding is conducted at a temperature such that the surfaces of the binder microfibers at least partially melt without causing the fibers to melt thereby bonding the binder microfibers to the fibers to produce the paper and/or nonwoven article.

In another embodiment of the invention, a process is provided for producing a paper and/or nonwoven article. The process can comprise the following steps:

(a) spinning at least one water dispersible sulfopolyester and one or more water non-dispersible synthetic polymers immiscible with the sulfopolyester into multicomponent fibers, wherein the multicomponent fibers have a plurality of domains comprising the water non-dispersible synthetic polymers whereby the domains are substantially isolated from each other by the sulfopolyester intervening between the domains; wherein the multicomponent fiber has an as-spun denier of less than about 15 denier per filament; wherein the water dispersible sulfopolyester exhibits a melt viscosity of less than about 12,000 poise measured at 240° C. at a strain rate of 1 rad/sec; and wherein the sulfopolyester comprises less than about 25 mole percent of residues of at least one sulfomonomer, based on the total moles of diacid or diol residues;

(b) cutting the multicomponent fibers of step a) to a length of less than 25, 12, 10, or 2 millimeters, but greater than 0.1, 0.25, or 0.5 millimeters to produce cut multicomponent fibers;

(c) contacting the cut multicomponent fibers with water to remove the sulfopolyester thereby forming a wet lap of binder microfibers comprising the water non-dispersible synthetic polymer;

(d) subjecting a plurality of fibers and the binder microfibers to a wet-laid nonwoven process to produce a wet-laid nonwoven web; wherein said water non-dispersible microfibers have a fineness of less than 0.5 d/f; and wherein the binder microfibers have a melting temperature that is less than the melting temperature of the fibers; and (e) removing water from the wet-laid nonwoven web; and (f) thermally bonding the wet-laid nonwoven web after step (e); wherein said thermal bonding is conducted at a temperature such that the surfaces of the binder microfibers at least partially melt without causing the fibers to melt thereby bonding the binder microfibers to the fibers to produce the paper or nonwoven article.

In one embodiment of the invention, at least 5, 10, 15, 20, 30, 40, or 50 weight percent and/or not more than 90, 75, or 60 weight percent of the nonwoven web comprises the binder microfiber.

In another embodiment of the invention, in step b), the multicomponent fibers of step a) are cut to a length of less than 25, 20, 15, 12, 10, 5, or 2 millimeters, but greater than 0.1, 0.25, or 0.5 millimeters.

A liquid binder may be applied to the nonwoven web by any method known in the art or another binder fiber can be added in the nonwoven web process. If an amount of liquid binder is applied, it will be dried before the thermal bonding step for the binder microfiber (preferably at a temperature less than that required for the thermal bonding of the binder microfiber) or simultaneously with the thermal bonding step for the binder microfiber. However, due to the strong binding nature of the binder microfibers, an additional binder is generally not necessary. In another embodiment of this invention, there is a substantial absence of an additional binder in the nonwoven web layer. "Substantial absence" is defined as less than 1% by weight of a liquid binder, fiber binder, or binder dispersion in the nonwoven web layer.

After producing the nonwoven web, adding the optional binder, and/or after adding the optional coating, the nonwoven web undergoes a thermal bonding step conducted at a temperature such that the surfaces of the binder microfibers at least partially melt without causing the other fibers to melt thereby bonding the water non-dispersible microfibers to the other fibers to produce the paper or nonwoven article.

Thermal bonding can be conducted by any process known in the art. In thermal bonding, the fiber surfaces are fused to each other by softening the binder microfiber surface. Two common thermal bonding methods are through-air heating and calendaring. In one embodiment of the invention, the through-air method uses hot air to fuse fibers within the nonwoven web and on the surface of the web by softening the binder microfibers. Hot air is either blown through the nonwoven web in a conveyorized oven or sucked through the nonwoven web as it is passed over a porous drum within which a vacuum is developed. In calendar thermal bonding, the web is drawn between heated cylinders. Ultrasound in the form of ultrahigh frequency energy can also be used for thermal bonding.

The nonwoven web layer may further comprise a coating. After the nonwoven web layer is subjected to drying and thermal bonding, a coating may be applied to the nonwoven web and/or paper. The coating can comprise a decorative coating, a printing ink, a barrier coating, an adhesive coating, and a heat seal coating. In another example, the coating can comprise a liquid barrier and/or a microbial barrier.

The fibers utilized in the nonwoven web layer can be any that is known in the art that can be utilized in wet-laid nonwoven processes. The fibers can have a different composition and/or configuration (e.g., length, minimum transverse dimension, maximum transverse dimension, cross-sectional shape, or combinations thereof) than the binder microfibers. The fiber can be selected from the group consisting of glass, cellulosic, and synthetic polymers. In another embodiment of the invention, the fiber can be selected from the group consisting of cellulosic fiber pulp, inorganic fibers (e.g., glass, carbon, boron, ceramic, and combinations thereof), polyester fibers, nylon fibers, polyolefin fibers, rayon fibers, lyocell fibers, acrylic fibers, cellulose ester fibers, post-consumer recycled fibers, and combinations thereof.

The nonwoven web can comprise fibers in an amount of at least 10, 15, 20, 25, 30, or 40 weight percent of the nonwoven web and/or not more than 99, 98, 95, 90, 85, 80, 70, 60, or 50 weight percent of the nonwoven web. In one embodiment, the fiber is a cellulosic fiber that comprises at least 10, 25, or 40 weight percent and/or no more than 90, 80, 70, 60, or 50 weight percent of the nonwoven web. The cellulosic fibers can comprise hardwood pulp fibers, softwood pulp fibers, and/or regenerated cellulose fibers.

In one embodiment, a combination of the fiber and binder microfibers make up at least 75, 85, 95, or 98 weight percent of the nonwoven web.

The nonwoven web can further comprise one or more additives. The additives may be added to the wet lap of binder microfibers prior to subjecting the wet lap to a wet-laid or dry-laid process. The additives may also be added to the wet-laid nonwoven as a component of the optional additional binder or coating composition. Additives include, but are not limited to, starches, fillers, light and heat stabilizers, antistatic agents, extrusion aids, dyes, anticounterfeiting markers, slip agents, tougheners, adhesion promoters, oxidative stabilizers, UV absorbers, colorants, pigments, opacifiers (delustrants), optical brighteners, fillers, nucleating agents, plasticizers, viscosity modifiers, surface modifiers, antimicrobials, antifoams, lubricants, thermostabilizers, emulsifiers, disinfectants, cold flow inhibitors, branching agents, oils, waxes, and catalysts. In one embodiment, the nonwoven web comprises an optical brightener and/or antimicrobials. The nonwoven web can comprise at least 0.05, 0.1, or 0.5 weight percent and/or not more than 10, 5, or 2 weight percent of one or more additives.

In one embodiment of the invention, the binder microfibers used to make the nonwoven web have an essentially round cross-section derived from a multicomponent fiber having an island-in-the-sea configuration in which the water non-dispersible polymer comprises the "islands" and the water-dispersible sulfopolyester comprises the "sea".

In another embodiment of the invention, the binder microfibers used to make the nonwoven web have an essentially wedge-shaped cross-section derived from a multicomponent fiber having a segmented-pie configuration in which alternating segments are comprised of water non-dispersible polymer and water-dispersible sulfopolyester. The relative "flatness" of the wed-shaped cross-section can be controlled by the number of segments in the segmented-pie configuration (e.g. 16, 32, or 64 segment) and/or by the ratio of water non-dispersible polymer and water-dispersible sulfopolyester present in the multicomponent fiber.

In yet another embodiment of the invention, the binder microfibers used to make the nonwoven web are ribbon fibers derived from a multicomponent fiber having a striped configuration in which alternating segments are comprised of water non-dispersible polymer and water-dispersible sulfopolyester. Such ribbon fibers can exhibit a transverse aspect ratio of at least 2:1, 4:1, 6:1, 8:1 or 10:1 and/or not more than 100:1, 50:1, or 20:1. As used herein, "transverse aspect ratio" denotes the ratio of a fiber's maximum transverse dimension to the fiber's minimum transverse dimension. As used herein, "maximum transverse dimension" is the maximum dimension of a fiber measured perpendicular to the axis of elongation of the fiber by the external caliper method described above.

Although it its known in the art that fibers having a transverse aspect ratio of 1.5:1 or greater can be produced by fibrillation of a base member (e.g., a sheet or a root fiber), the ribbon fibers provided in accordance with one embodiment of the present invention are not made by fibrillating a sheet or root fiber to produce a "fuzzy" sheet or root fiber having microfibers appended thereto. Rather, in one embodiment of the present invention, less than 50, 20, or 5 weight percent of ribbon fibers employed in the nonwoven web are joined to a base member having the same composition as said ribbon fibers. In one embodiment, the ribbon fibers are derived from striped multicomponent fibers having said ribbon fibers as a component thereof.

When the nonwoven web of the present invention comprises short-cut ribbon microfibers, as the binder microfibers, the major transverse axis of at least 50, 75, or 90 weight percent of the ribbon microfibers in the nonwoven web can be oriented at an angle of less than 30, 20, 15, or 10 degrees from the nearest surface of the nonwoven web. As used herein, "major transverse axis" denotes an axis perpendicular to the direction of elongation of a fiber and extending through the centermost two points on the outer surface of the fiber between which the maximum transverse dimension of the fiber is measured by the external caliper method described above. Such orientation of the ribbon fibers in the nonwoven web can be facilitated by enhanced dilution of the fibers in a wet-laid process and/or by mechanically pressing the nonwoven web after its formation. FIG. 2 illustrates how the angle of orientation of the ribbon fibers relative to the major transverse axis is determined.

Generally, manufacturing processes to produce nonwoven webs utilizing binder microfibers derived from multicomponent fibers can be split into the following groups: dry-laid webs, wet-laid webs, and combinations of these processes with each other or other nonwoven processes.

Generally, dry-laid nonwoven webs are made with staple fiber processing machinery that is designed to manipulate fibers in a dry state. These include mechanical processes, such as carding, aerodynamic, and other air-laid routes. Also included in this category are nonwoven webs made from filaments in the form of tow, fabrics composed of staple fibers, and stitching filaments or yards (i.e., stitchbonded nonwovens). Carding is the process of disentangling, cleaning, and intermixing fibers to make a web for further processing into a nonwoven web. The process predominantly aligns the fibers which are held together as a web by mechanical entanglement and fiber-fiber friction. Cards (e.g., a roller card) are generally configured with one or more main cylinders, roller or stationary tops, one or more doffers, or various combinations of these principal components. The carding action is the combing or working of the fibers between the points of the card on a series of interworking card rollers. Types of cards include roller, woolen, cotton, and random cards. Garnetts can also be used to align these fibers.

The binder microfibers in the dry-laid process can also be aligned by air-laying. These fibers are directed by air current onto a collector which can be a flat conveyor or a drum.

Wet laid processes involve the use of papermaking technology to produce nonwoven webs. These nonwoven webs are made with machinery associated with pulp fiberizing (e.g., hammer mills) and paperforming (e.g., slurry pumping onto continuous screens which are designed to manipulate short fibers in a fluid).

In one embodiment of the wet laid process, the fibers and the binder microfibers are suspended in water, brought to a forming unit wherein the water is drained off through a forming screen, and the fibers are deposited on the screen wire.

In another embodiment of the wet laid process, the fibers and the binder microfibers are dewatered on a sieve or a wire mesh which revolves at high speeds of up to 1,500 meters per minute at the beginning of hydraulic formers over dewatering modules (e.g., suction boxes, foils, and curatures). The sheet is dewatered to a solid content of approximately 20 to 30 percent. The sheet can then be pressed and dried.

In another embodiment of the wet-laid process, a process is provided comprising:

(a) optionally, rinsing the binder microfibers with water;
(b) adding water to the binder microfibers to produce microfiber slurry;
(c) adding other fibers and optionally, additives to the microfiber slurry to produce a fiber furnish;
(d) transferring the fiber furnish to a wet-laid nonwoven process to produce the nonwoven web;
(e) removing water from the wet-laid nonwoven web layer; and
(f) thermally bonding the wet-laid nonwoven web layer after step (e); wherein said thermal bonding is conducted at a temperature such that the surfaces of the binder microfibers at least partially melt without causing the fibers to melt thereby bonding the binder microfibers to the fibers to produce the paper and/or nonwoven article.
(g) optionally, applying a coating to the thermally-bonded paper and/or nonwoven article.

In step (a), the number of rinses depends on the particular use chosen for the wet-laid nonwoven web layer. In step (b), sufficient water is added to the binder microfibers to allow them to be routed to the wet-laid nonwoven process.

The wet-laid nonwoven process in step (d) comprises any equipment known in the art that can produce wet-laid nonwoven webs. In one embodiment of the invention, the wet-laid nonwoven zone comprises at least one screen, mesh, or sieve in order to remove the water from the microfiber slurry. In another embodiment of the invention the wet-laid nonwoven web is produced using a Fourdrinier or inclined wire process.

In another embodiment of the invention, the microfiber slurry is mixed prior to transferring to the wet-laid nonwoven zone.

The mixture of fibers and binder microfibers are often deposited in a random manner, although orientation in one direction is possible, followed by bonding using one of the methods described above. In one embodiment, the binder microfibers can be substantially evenly distributed throughout the nonwoven web. The nonwoven webs also may comprise one or more layers of water-dispersible fibers, multicomponent fibers, microdenier fibers, or binder microfibers.

The nonwoven webs may also include various powders and particulates to improve the absorbency nonwoven web and its ability to function as a delivery vehicle for other additives. Examples of powders and particulates include, but are not limited to, talc, starches, various water absorbent, water-dispersible, or water swellable polymers (e.g., super absorbent polymers, sulfopolyesters, and poly(vinylalcohols)), silica, activated carbon, pigments, and microcapsules. As previously mentioned, additives may also be present, but are not required, as needed for specific applications. Examples of additives include, but are not limited to, fillers, light and heat stabilizers, antistatic agents, extrusion aids, dyes, anticounterfeiting markers, slip agents, tougheners, adhesion promoters, oxidative stabilizers, UV absorbers, colorants, pigments, opacifiers (delustrants), optical brighteners, fillers, nucleating agents, plasticizers, viscosity modifiers, surface modifiers, antimicrobials, antifoams, lubricants, thermostabilizers, emulsifiers, disinfectants, cold flow inhibitors, branching agents, oils, waxes, and catalysts.

A major advantage inherent to the water dispersible sulfopolyesters of the present invention relative to caustic-dissipatable polymers (including sulfopolyesters) known in the art is the facile ability to remove or recover the polymer from aqueous dispersions via flocculation and precipitation by adding ionic moieties (i.e., salts). pH adjustment, adding nonsolvents, freezing, membrane filtration, and so forth may also be employed. The recovered water dispersible sulfopolyester may find use in applications including, but not limited to, a binder for wet-laid nonwovens.

Another advantage inherent to the water dispersible sulfopolyesters of the present invention relative to caustic-dissipatable polymers (including sulfopolyesters) known in the art is that there is essentially no chemical degradation of hydrolytically-sensitive water non-dispersible polymers such as polyesters or polyamides during the removal of the water dispersible sulfopolyester whereas measurable and meaningful levels of water non-dispersible fiber degradation can occur when those hydrolytically-sensitive water non-dispersible polymers are subjected to hot caustic. The resulting degradation can be manifested as a loss of strength or a loss of uniformity in the resulting microfiber.

The binder microfibers of the present invention are produced from a microfiber-generating multicomponent fiber that includes at least two components, at least one of which is a water-dispersible sulfopolyester and at least one of which is a water non-dispersible synthetic polymer. As is discussed below in further detail, the water-dispersible component can comprise a sulfopolyester fiber and the water non-dispersible component can comprise a water non-dispersible synthetic polymer.

The term "multicomponent fiber'" as used herein, is intended to mean a fiber prepared by melting at least two or more fiber-forming polymers in separate extruders, directing the resulting multiple polymer flows into one spinneret with a plurality of distribution flow paths, and spinning the flow paths together to form one fiber. Multicomponent fibers are also sometimes referred to as conjugate or bicomponent fibers. The polymers are arranged in distinct segments or configurations across the cross-section of the multicomponent fibers and extend continuously along the length of the multicomponent fibers. The configurations of such multicomponent fibers may include, for example, sheath core, side by side, segmented pie, striped, or islands-in-the-sea. For example, a multicomponent fiber may be prepared by extruding the sulfopolyester and one or more water non-dispersible synthetic polymers separately through a spinneret having a shaped or engineered transverse geometry such as, for example, an "islands-in-the-sea," striped, or segmented pie configuration.

Additional disclosures regarding multicomponent fibers, how to produce them, and their use to generate microfibers are disclosed in U.S. Pat. Nos. 6,989,193; 7,902,094; 7,892,993; 7,687,143; and US Patent Application Publication Nos. 2008/0311815, 2011/0139386; Ser. Nos. 13/433,812; 13/433,854; 13/671,682; and U.S. patent application Ser. Nos. 13/687,466; 13/687,472; 13/687,478; 13/687,493; and 13/687,505, the disclosures of which are incorporated herein by reference.

The terms "segment," and/or "domain," when used to describe the shaped cross section of a multicomponent fiber refer to the area within the cross section comprising the water non-dispersible synthetic polymers. These domains or segments are substantially isolated from each other by the water-dispersible sulfopolyester, which intervenes between the segments or domains. The term "substantially isolated," as used herein, is intended to mean that the segments or domains are set apart from each other to permit the segments or domains to form individual fibers upon removal of the water dispersible sulfopolyester. Segments or domains can be of similar shape and size within the multicomponent fiber cross-section or can vary in shape and/or size. Furthermore, the segments or domains can be "substantially continuous" along the length of the multicomponent fiber. The term "substantially continuous" means that the segments or domains are continuous along at least 10 cm length of the multicomponent fiber. These segments or domains of the multicomponent fiber produce the water non-dispersible microfibers when the water dispersible sulfopolyester is removed.

The term "water-dispersible," as used in reference to the water-dispersible component and the sulfopolyesters is intended to be synonymous with the terms "water-dissipatable," "water-disintegratable," "water-dissolvable," "water-dispellable," "water soluble," "water-removable," "hydrosoluble," and "hydrodispersible" and is intended to mean that the sulfopolyester component is sufficiently removed from the multicomponent fiber and is dispersed and/or dissolved by the action of water to enable the release and separation of the water non-dispersible fibers contained therein. The terms "dispersed," "dispersible," "dissipate," or "dissipatable" mean that, when using a sufficient amount of deionized water (e.g., 100:1 water:fiber by weight) to form a loose suspension or slurry of the sulfopolyester fibers at a temperature of about 60° C., and within a time period of up to 5 days, the sulfopolyester component dissolves, disintegrates, or separates from the multicomponent fiber, thus leaving behind a plurality of microfibers from the water non-dispersible segments.

In the context of this invention, all of these terms refer to the activity of water or a mixture of water and a water-miscible cosolvent on the sulfopolyesters described herein. Examples of such water-miscible cosolvents includes alcohols, ketones, glycol ethers, esters and the like. It is intended for this terminology to include conditions where the sulfopolyester is dissolved to form a true solution as well as those where the sulfopolyester is dispersed within the aqueous medium. Often, due to the statistical nature of sulfopolyester compositions, it is possible to have a soluble fraction and a dispersed fraction when a single sulfopolyester sample is placed in an aqueous medium.

The term "polyester", as used herein, encompasses both "homopolyesters" and "copolyesters" and means a synthetic polymer prepared by the polycondensation of difunctional carboxylic acids with a difunctional hydroxyl compound. Typically, the difunctional carboxylic acid is a dicarboxylic acid and the difunctional hydroxyl compound is a dihydric alcohol such as, for example, glycols and diols. Alternatively, the difunctional carboxylic acid may be a hydroxy carboxylic acid such as, for example, p-hydroxybenzoic acid, and the difunctional hydroxyl compound may be an aromatic nucleus bearing two hydroxy substituents such as, for example, hydroquinone. As used herein, the term "sulfopolyester" means any polyester comprising a sulfomonomer. The term "residue," as used herein, means any organic structure incorporated into a polymer through a polycondensation reaction involving the corresponding monomer. Thus, the dicarboxylic acid residue may be derived from a dicarboxylic acid monomer or its associated acid halides, esters, salts, anhydrides, or mixtures thereof. Therefore, the term dicarboxylic acid is intended to include dicarboxylic acids and any derivative of a dicarboxylic acid, including its associated acid halides, esters, half-esters, salts, half-salts, anhydrides, mixed anhydrides, or mixtures thereof, useful in a polycondensation process with a diol to make high molecular weight polyesters.

The water-dispersible sulfopolyesters generally comprise dicarboxylic acid monomer residues, sulfomonomer residues, diol monomer residues, and repeating units. The sulfomonomer may be a dicarboxylic acid, a diol, or hydroxycarboxylic acid. The term "monomer residue," as used herein, means a residue of a dicarboxylic acid, a diol, or a hydroxycarboxylic acid. A "repeating unit," as used herein, means an organic structure having 2 monomer residues bonded through a carbonyloxy group. The sulfopolyesters of the present invention contain substantially equal molar proportions of acid residues (100 mole percent) and diol residues (100 mole percent), which react in substantially equal proportions such that the total moles of repeating units is equal to 100 mole percent. The mole percentages provided in the present disclosure, therefore, may be based on the total moles of acid residues, the total moles of diol residues, or the total moles of repeating units. For example, a sulfopolyester containing 30 mole percent of a sulfomonomer, which may be a dicarboxylic acid, a diol, or hydroxycarboxylic acid, based on the total repeating units, means that the sulfopolyester contains 30 mole percent sulfomonomer out of a total of 100 mole percent repeating units. Thus, there are 30 moles of sulfomonomer residues among every 100 moles of repeating units. Similarly, a sulfopolyester containing 30 mole percent of a sulfonated dicarboxylic acid, based on the total acid residues, means the sulfopolyester contains 30 mole percent sulfonated dicarboxlyic acid out of a total of 100 mole percent acid residues. Thus, in this latter case, there are 30 moles of sulfonated dicarboxylic acid residues among every 100 moles of acid residues.

In addition, our invention also provides a process for producing the multicomponent fibers and the binder microfibers derived therefrom, the process comprising (a) producing the multicomponent fiber and (b) generating the binder microfibers from the multicomponent fibers.

The process begins by (a) spinning a water dispersible sulfopolyester having a glass transition temperature (Tg) of at least 36° C., 40° C., or 57° C. and one or more water non-dispersible synthetic polymers immiscible with the sulfopolyester into multicomponent fibers. The multicomponent fibers can have a plurality of segments or domains comprising the water non-dispersible synthetic polymers that are substantially isolated from each other by the sulfopolyester, which intervenes between the segments or domains. The sulfopolyester comprises:

(i) about 50 to about 96 mole percent of one or more residues of isophthalic acid and/or terephthalic acid, based on the total acid residues;

(ii) about 4 to about 30 mole percent, based on the total acid residues, of a residue of sod iosulfoisophthalic acid;

(iii) one or more diol residues, wherein at least 25 mole percent, based on the total diol residues, is a poly (ethylene glycol) having a structure $H—(OCH_2—CH_2)_n—OH$ wherein n is an integer in the range of 2 to about 500; and (iv) 0 to about 20 mole percent, based on the total repeating units, of residues of a branching monomer having 3 or more functional groups wherein the functional groups are hydroxyl, carboxyl, or a combination thereof. Ideally, the sulfopolyester has a melt viscosity of less than 12,000, 8,000, or 6,000 poise measured at 240° C. at a strain rate of 1 rad/sec.

The binder microfibers are generated by (b) contacting the multicomponent fibers with water to remove the sulfopolyester thereby forming the binder microfibers comprising the water non-dispersible synthetic polymer. The water non-dispersible binder microfibers of the instant invention can have an average fineness of at least 0.001, 0.005, or 0.01 dpf and/or no more than 0.1 or 0.5 dpf. Typically, the multicomponent fiber is contacted with water at a temperature of about 25° C. to about 100° C., preferably about 50° C. to about 80° C., for a time period of from about 10 to about 600 seconds whereby the sulfopolyester is dissipated or dissolved.

The ratio by weight of the sulfopolyester to water non-dispersible synthetic polymer component in the multicomponent fiber of the invention is generally in the range of about 98:2 to about 2:98 or, in another example, in the range of about 25:75 to about 75:25. Typically, the sulfopolyester comprises 50 percent by weight or less of the total weight of the multicomponent fiber.

The shaped cross section of the multicomponent fibers can be, for example, in the form of a sheath core, islands-in-the-sea, segmented pie, hollow segmented pie, off-centered segmented pie, or striped.

For example, the striped configuration can have alternating water dispersible segments and water non-dispersible segments and have at least 4, 8, or 12 stripes and/or less than 50, 35, or 20 stripes while a segmented pie configuration can have alternating water dispersible segments and water non-dispersible segments and have at least 16, 32, or 64 total segments and an islands-in-the-sea cross-section can have at least 400, 250, or 100 islands.

The multicomponent fibers of the present invention can be prepared in a number of ways. For example, in U.S. Pat. No. 5,916,678, multicomponent fibers may be prepared by extruding the sulfopolyester and one or more water non-dispersible synthetic polymers, which are immiscible with the sulfopolyester, separately through a spinneret having a shaped or engineered transverse geometry such as, for example, islands-in-the-sea, sheath core, side-by-side, striped, or segmented pie. The sulfopolyester may be later removed by dispersing, depending on the shaped cross-section of the multicomponent fiber, the interfacial layers, pie segments, or "sea" component of the multicomponent fiber and leaving the binder microfibers of the water non-dispersible synthetic polymer(s). These binder microfibers of the water non-dispersible synthetic polymer(s) have fiber sizes much smaller than the multicomponent fiber.

In another embodiment of this invention, another process is provided to produce binder microfibers. The process comprises:

(a) cutting a multicomponent fiber into cut multicomponent fibers having a length of less than 25 millimeters to produce cut multicomponent fibers;

(b) contacting the cut multicomponent fibers with a wash water for at least 0.1, 0.5, or 1 minutes and/or not more than 30, 20, or 10 minutes to produce a fiber mix slurry, wherein the wash water can have a pH of less than 10, 8, 7.5, or 7 and can be substantially free of added caustic;

(c) heating said fiber mix slurry to produce a heated fiber mix slurry;

(d) optionally, mixing said fiber mix slurry in a shearing zone;

(e) removing at least a portion of the sulfopolyester from the multicomponent fiber to produce a slurry mixture comprising a sulfopolyester dispersion and the binder microfibers;

(f) removing at least a portion of the sulfopolyester dispersion from the slurry mixture to thereby provide a wet lap comprising the binder microfibers, wherein the wet lap is comprised of at least 5, 10, 15, or 20 weight percent and/or not more than 70, 55, or 40 weight percent of the water non-dispersible microfiber and at least 30, 45, or 60 weight percent and/or not more than 90, 85, or 80 weight percent of the sulfopolyester dispersion;

(g) combining the wet lap of binder microfibers and a plurality of other fibers with a dilution liquid to produce a dilute wet-lay slurry or "fiber furnish" in an amount of at least 0.001, 0.005, or 0.01 weight percent and/or not more than 1, 0.5, or 0.1 weight percent; wherein the binder microfibers have a fineness of less than 0.5 g/f; and wherein the binder microfibers have a melting temperature that is less than the melting temperature of the fibers (h) routing the fiber furnish to a wet-laid nonwoven process to produce a wet-laid nonwoven web; and (i) removing water from the wet-laid nonwoven web; and (j) thermally bonding the wet-laid nonwoven web after step (i); wherein said thermal bonding is conducted at a temperature such that the surfaces of the binder microfibers at least partially melt without causing the fibers to melt thereby bonding the binder microfibers to the fibers to produce the paper or nonwoven article.

(k) optionally, applying a coating to the paper of nonwoven article.

In another embodiment of the invention, the wet lap is comprised of at least 5, 10, 15, or 20 weight percent and/or not more than 50, 45, or 40 weight percent of the binder microfiber and at least 50, 55, or 60 weight percent and/or not more than 90, 85, or 80 weight percent of the sulfopolyester dispersion.

The multicomponent fiber can be cut into any length that can be utilized to produce nonwoven webs. In one embodiment of the invention, the multicomponent fiber is cut into lengths ranging of at least 0.1, 0.25, or 0.5 millimeter and/or not more than 25, 12, 10, 5, or 2 millimeter. In one embodiment, the cutting ensures a consistent fiber length so that at least 75, 85, 90, 95, or 98 percent of the individual fibers have an individual length that is within 90, 95, or 98 percent of the average length of all fibers.

The fibers utilized in the fiber furnish have previously been discussed.

The cut multicomponent fibers are mixed with a wash water to produce a fiber mix slurry. Preferably, to facilitate the removal of the water-dispersible sulfopolyester, the water utilized can be soft water or deionized water. The wash water can have a pH of less than 10, 8, 7.5, or 7 and can be substantially free of added caustic. The wash water can be maintained at a temperature of at least 60° C., 65° C., or 70° C. and/or not more than 100° C., 95° C., or 90° C. during contacting of step (b). In one embodiment, the wash water contacting of step (b) can disperse substantially all of the water-dispersible sulfopolyester segments of the multicomponent fiber, so that the dissociated water non-dispersible microfibers have less than 5, 2, or 1 weight percent of residual water dispersible sulfopolyester disposed thereon.

Optionally, the fiber mix slurry can be mixed in a shearing zone. The amount of mixing is that which is sufficient to disperse and remove a portion of the water dispersible sulfopolyester from the multicomponent fiber. During mixing, at least 90, 95, or 98 weight percent of the sulfopolyester can be removed from the water non-dispersible microfiber. The shearing zone can comprise any type of equipment that can provide a turbulent fluid flow necessary to disperse and remove a portion of the water dispersible sulfopolyester from the multicomponent fiber and separate the water non-dispersible microfibers. Examples of such equipment include, but is not limited to, pulpers and refiners.

After contacting the multicomponent fiber with water, the water dispersible sulfopolyester dissociates with the water non-dispersible synthetic polymer domains or segments to produce a slurry mixture comprising a sulfopolyester dispersion and the binder microfibers. The sulfopolyester dispersion can be separated from the binder microfibers by any means known in the art in order to produce a wet lap, wherein the sulfopolyester dispersion and binder microfibers in combination can make up at least 95, 98, or 99 weight percent of the wet lap. For example, the slurry mixture can be routed through separating equipment such as, for example, screens and filters. Optionally, the binder microfibers may be washed once or numerous times to remove more of the water dispersible sulfopolyester.

The wet lap can comprise up to at least 30, 45, 50, 55, or 60 weight percent and/or not more than 90, 86, 85, or 80 weight percent water. Even after removing some of the sulfopolyester dispersion, the wet lap can comprise at least 0.001, 0.01, or 0.1 and/or not more than 10, 5, 2, or 1 weight percent of water dispersible sulfopolyesters. In addition, the wet lap can further comprise a fiber finishing composition comprising an oil, a wax, and/or a fatty acid. The fatty acid and/or oil used for the fiber finishing composition can be naturally-derived. In another embodiment, the fiber finishing composition comprises mineral oil, stearate esters, sorbitan esters, and/or neatsfoot oil. The fiber finishing composition can make up at least 10, 50, or 100 ppmw and/or not more than 5,000, 1000, or 500 ppmw of the wet lap.

The removal of the water-dispersible sulfopolyester can be determined by physical observation of the slurry mixture. The water utilized to rinse the water non-dispersible microfibers is clear if the water-dispersible sulfopolyester has been mostly removed. If the water dispersible sulfopolyester is still present in noticeable amounts, then the water utilized to rinse the water non-dispersible microfibers can be milky in color. Further, if water-dispersible sulfopolyester remains on the binder microfibers, the microfibers can be somewhat sticky to the touch.

The dilute wet-lay slurry or fiber furnish of step (g) can comprise the dilution liquid in an amount of at least 90, 95, 98, 99, or 99.9 weight percent.

In one embodiment of this invention, at least one water softening agent may be used to facilitate the removal of the water-dispersible sulfopolyester from the multicomponent fiber. Any water softening agent known in the art can be utilized. In one embodiment, the water softening agent is a chelating agent or calcium ion sequestrant. Applicable chelating agents or calcium ion sequestrants are compounds containing a plurality of carboxylic acid groups per molecule where the carboxylic groups in the molecular structure of the chelating agent are separated by 2 to 6 atoms. Tetrasodium ethylene diamine tetraacetic acid (EDTA) is an example of the most common chelating agent, containing four carboxylic acid moieties per molecular structure with a separation of 3 atoms between adjacent carboxylic acid groups. Sodium salts of maleic acid or succinic acid are examples of the most basic chelating agent compounds. Further examples of applicable chelating agents include compounds which have multiple carboxylic acid groups in the molecular structure wherein the carboxylic acid groups are separated by the required distance (2 to 6 atom units) which yield a favorable steric interaction with di- or multivalent cations such as calcium which cause the chelating agent to preferentially bind to di- or multi valent cations. Such compounds include, for example, diethylenetriamine-pentaacetic acid; diethylenetriamine-N,N,N',N',N"-pentaacetic acid; pentetic acid; N,N-bis(2-(bis-(carboxymethyl) amino)ethyl)-glycine; diethylenetriamine pentaacetic acid; [[(carboxymethyl)imino]bis(ethylenenitrilo)]-tetra-acetic acid; edetic acid; ethylenedinitrilotetraacetic acid; EDTA, free base; EDTA, free acid; ethylenediamine-N,N,N',N'-tetraacetic acid; hampene; versene; N,N'-1,2-ethane diylbis-(N-(carboxymethyl)glycine); ethylenediamine tetra-acetic acid; N,N-bis(carboxymethyl)glycine; triglycollamic acid; trilone A; α,α',α"-5 trimethylaminetricarboxylic acid; tri (carboxymethyl)amine; aminotriacetic acid; hampshire NTA acid; nitrilo-2,2',2"-triacetic acid; titriplex i; nitrilotriacetic acid; and mixtures thereof.

The water dispersible sulfopolyester can be recovered from the sulfopolyester dispersion by any method known in the art.

As described above, the binder microfiber produced by this process comprises at least one water non-dispersible synthetic polymer. Depending on the cross section configuration of the multicomponent fiber from which the binder microfiber is derived from, the binder microfiber will be described by at least one of the following: an equivalent diameter of less than 15, 10, 5, or 2 microns; a minimum transverse dimension of less than 5, 4, or 3 microns; an transverse ratio of at least 2:1, 4.1, 6:1, 8:1, or 10:1 and/or not more than 100:1, 50:1, or 20:1, a thickness of at least 0.1, 0.5, or 0.75 microns and/or not more than 10, 5, or 2 microns; an average fineness of at least 0.001, 0.005, or 0.01 dpf and/or not more than 0.1 or 0.5 dpf; and/or a length of at least 0.1, 0.25, or 0.5 millimeters and/or not more than 25, 12, 10, 6.5, 5, 3.5, or 2.0 millimeters. All fiber dimensions provided herein (e.g., equivalent diameter, length, minimum transverse dimension, maximum transverse dimension, transverse aspect ratio, and thickness) are the average dimensions of the fibers in the specified group.

As briefly discussed above, the microfibers of the present invention can be advantageous in that they are not formed by fibrillation. Fibrillated microfibers are directly joined to a base member (i.e., the root fiber and/or sheet) and have the same composition as the base member. In contrast, at least 75, 85, or 95 weight percent of the water non-dispersible microfibers of the present invention are unattached, independent, and/or distinct, and are not directly attached to a base member. In one embodiment, less than 50, 20, or 5 weight percent of the microfibers are directly joined to a base member having the same composition as the microfibers.

The sulfopolyesters described herein can have an inherent viscosity, abbreviated hereinafter as "I.V.", of at least about 0.1, 0.2, or 0.3 dL/g, preferably about 0.2 to 0.3 dL/g, and most preferably greater than about 0.3 dL/g, as measured in 60/40 parts by weight solution of phenol/tetrachloroethane solvent at 25° C. and at a concentration of about 0.5 g of sulfopolyester in 100 mL of solvent.

The sulfopolyesters utilized to form the multicomponent fiber from which the binder microfibers are produced can include one or more dicarboxylic acid residues. Depending on the type and concentration of the sulfomonomer, the dicarboxylic acid residue may comprise at least 60, 65, or 70 mole percent and no more than 95 or 100 mole percent of the acid residues. Examples of dicarboxylic acids that may be used include aliphatic dicarboxylic acids, alicyclic dicarboxylic acids, aromatic dicarboxylic acids, or mixtures of two or more of these acids. Thus, suitable dicarboxylic acids include, but are not limited to, succinic, glutaric, adipic, azelaic, sebacic, fumaric, maleic, itaconic, 1,3-cyclohexanedicarboxylic, 1,4cyclohexanedicarboxylic, diglycolic, 2,5-norbornanedicarboxylic, phthalic, terephthalic, 1,4-naphthalenedicarboxylic, 2,5-naphthalenedicarboxylic, diphenic, 4,4'-oxydibenzoic, 4,4'-sulfonyidibenzoic, and isophthalic. The preferred dicarboxylic acid residues are isophthalic, terephthalic, and 1,4-cyclohexanedicarboxylic acids, or if diesters are used, dimethyl terephthalate, dimethyl isophthalate, and dimethyl-1,4-cyclohexanedicarboxylate with the residues of isophthalic and terephthalic acid being especially preferred. Although the dicarboxylic acid methyl ester is the most preferred embodiment, it is also acceptable to include higher order alkyl esters, such as ethyl, propyl, isopropyl, butyl, and so forth. In addition, aromatic esters, particularly phenyl, also may be employed.

The sulfopolyesters can include at least 4, 6, or 8 mole percent and no more than about 40, 35, 30, or 25 mole percent, based on the total repeating units, of residues of at least one sulfomonomer having 2 functional groups and one or more sulfonate groups attached to an aromatic or cycloaliphatic ring wherein the functional groups are hydroxyl, carboxyl, or a combination thereof. The sulfomonomer may be a dicarboxylic acid or ester thereof containing a sulfonate group, a diol containing a sulfonate group, or a hydroxy acid containing a sulfonate group. The term "sulfonate" refers to a salt of a sulfonic acid having the structure "$—SO_3M$," wherein M is the cation of the sulfonate salt. The cation of the sulfonate salt may be a metal ion such as $Li^+$, $Na^+$, $K^+$, and the like.

When a monovalent alkali metal ion is used as the cation of the sulfonate salt, the resulting sulfopolyester is completely dispersible in water with the rate of dispersion dependent on the content of sulfomonomer in the polymer, temperature of the water, surface area/thickness of the sulfopolyester, and so forth. When a divalent metal ion is used, the resulting sulfopolyesters are not readily dispersed by cold water but are more easily dispersed by hot water. Utilization of more than one counterion within a single polymer composition is possible and may offer a means to tailor or fine-tune the water-responsivity of the resulting article of manufacture. Examples of sulfomonomers residues include monomer residues where the sulfonate salt group is attached to an aromatic acid nucleus, such as, for example, benzene, naphthalene, diphenyl, oxydiphenyl, sulfonyldiphenyl, methylenediphenyl, or cycloaliphatic rings (e.g., cyclopentyl, cyclobutyl, cycloheptyl, and cyclooctyl). Other examples of sulfomonomer residues which may be used in the present invention are the metal sulfonate salts of sulfophthalic acid, sulfoterephthalic acid, sulfoisophthalic acid, or combinations thereof. Other examples of sulfomonomers which may be used include 5-sodiosulfoisophthalic acid and esters thereof.

The sulfomonomers used in the preparation of the sulfopolyesters are known compounds and may be prepared using methods well known in the art. For example, sulfomonomers in which the sulfonate group is attached to an aromatic ring may be prepared by sulfonating the aromatic compound with oleum to obtain the corresponding sulfonic acid and followed by reaction with a metal oxide or base, for example, sodium acetate, to prepare the sulfonate salt. Procedures for preparation of various sulfomonomers are described, for example, in U.S. Pat. No. 3,779,993; U.S. Pat. No. 3,018,272; and U.S. Pat. No. 3,528,947, the disclosures of which are incorporated herein by reference.

The sulfopolyesters can include one or more diol residues which may include aliphatic, cycloaliphatic, and aralkyl glycols. The cycloaliphatic diols, for example, 1,3- and 1,4-cyclohexanedimethanol, may be present as their pure cis or trans isomers or as a mixture of cis and trans isomers. As used herein, the term "diol" is synonymous with the term "glycol" and can encompass any dihydric alcohol. Examples of diols include, but are not limited to, ethylene glycol, diethylene glycol, triethylene glycol, polyethylene glycols, 1,3-propanediol, 2,4-dimethyl-2-ethylhexane-1,3-diol, 2,2-dimethyl-1,3-propanediol, 2-ethyl-2-butyl-1,3-propanediol, 2-ethyl-2-isobutyl-1,3-propanediol, 1,3-butanediol, 1,4-butanediol, 1,5-pentanediol, 1,6-hexanediol, 2,2,4-trimethyl-1,6-hexanediol, thiodiethanol, 1,2-cyclohexanedimethanol, 1,3-cyclohexanedimethanol, 1,4-cyclohexanedimethanol, 2,2,4,4-tetramethyl-1,3-cyclobutanediol, p-xylylenediol, or combinations of one or more of these glycols.

The diol residues may include from about 25 mole percent to about 100 mole percent, based on the total diol residues, of residues of a poly(ethylene glycol) having a structure $H—(OCH_2—CH_2)_n—OH$, wherein n is an integer in the range of 2 to about 500. Non-limiting examples of lower molecular weight polyethylene glycols (e.g., wherein n is from 2 to 6) are diethylene glycol, triethylene glycol, and tetraethylene glycol. Of these lower molecular weight glycols, diethylene and triethylene glycol are most preferred. Higher molecular weight polyethylene glycols (abbreviated herein as "PEG"), wherein n is from 7 to about 500, include the commercially available products known under the designation CARBOWAX®, a product of Dow Chemical Company (formerly Union Carbide). Typically, PEGs are used in combination with other diols such as, for example, diethylene glycol or ethylene glycol. Based on the values of n, which range from greater than 6 to 500, the molecular weight may range from greater than 300 to about 22,000 g/mol. The molecular weight and the mole percent are inversely proportional to each other; specifically, as the molecular weight is increased, the mole percent will be decreased in order to achieve a designated degree of hydrophilicity. For example, it is illustrative of this concept to consider that a PEG having a molecular weight of 1,000 g/mol may constitute up to 10 mole percent of the total diol, while a PEG having a molecular weight of 10,000 g/mol would typically be incorporated at a level of less than 1 mole percent of the total diol.

Certain dimer, trimer, and tetramer diols may be formed in situ due to side reactions that may be controlled by varying the process conditions. For example, varying amounts of diethylene, triethylene, and tetraethylene glycols may be derived from ethylene glycol using an acid-catalyzed dehydration reaction which occurs readily when the polycondensation reaction is carried out under acidic conditions. The presence of buffer solutions, well known to those skilled in the art, may be added to the reaction mixture to retard these side reactions. Additional compositional latitude is possible, however, if the buffer is omitted and the dimerization, trimerization, and tetramerization reactions are allowed to proceed.

The sulfopolyesters of the present invention may include from 0 to less than 25, 20, 15, or 10 mole percent, based on the total repeating units, of residues of a branching monomer having 3 or more functional groups wherein the functional groups are hydroxyl, carboxyl, or a combination thereof. Non-limiting examples of branching monomers are 1,1,1-trimethylol propane, 1,1,1-trimethylolethane, glycerin, pentaerythritol, erythritol, threitol, dipentaerythritol, sorbitol, trimellitic anhydride, pyromellitic dianhydride, dimethylol propionic acid, or combinations thereof. The presence of a branching monomer may result in a number of possible benefits to the sulfopolyesters, including but not limited to, the ability to tailor rheological, solubility, and tensile properties. For example, at a constant molecular weight, a branched sulfopolyester, compared to a linear analog, will also have a greater concentration of end groups that may facilitate post-polymerization crosslinking reactions. At high concentrations of branching agent, however, the sulfopolyester may be prone to gelation.

The sulfopolyester used for the multicomponent fiber can have a glass transition temperature, abbreviated herein as "Tg," of at least 25° C., 30° C., 36° C., 40° C., 45° C., 50° C., 55° C., 57° C., 60° C., or 65° C. as measured on the dry polymer using standard techniques well known to persons skilled in the art, such as differential scanning calorimetry ("DSC"). The Tg measurements of the sulfopolyesters are conducted using a "dry polymer," that is, a polymer sample in which adventitious or absorbed water is driven off by heating the polymer to a temperature of about 200° C. and allowing the sample to return to room temperature. Typically, the sulfopolyester is dried in the DSC apparatus by conducting a first thermal scan in which the sample is heated to a temperature above the water vaporization temperature, holding the sample at that temperature until the vaporization of the water absorbed in the polymer is complete (as indicated by a large, broad endotherm), cooling the sample to room temperature, and then conducting a second thermal scan to obtain the Tg measurement.

In one embodiment, our invention provides a sulfopolyester having a glass transition temperature (Tg) of at least 25° C., wherein the sulfopolyester comprises:

(a) at least 50, 60, 75, or 85 mole percent and no more than 96, 95, 90, or 85 mole percent of one or more residues of isophthalic acid and/or terephthalic acid, based on the total acid residues;

(b) about 4 to about 30 mole percent, based on the total acid residues, of a residue of sod iosulfoisophthalic acid;

(c) one or more diol residues wherein at least 25, 50, 70, or 75 mole percent, based on the total diol residues, is a poly(ethylene glycol) having a structure $H—(OCH_2—CH_2)_n—OH$ wherein n is an integer in the range of 2 to about 500;

(d) 0 to about 20 mole percent, based on the total repeating units, of residues of a branching monomer having 3 or more functional groups wherein the functional groups are hydroxyl, carboxyl, or a combination thereof.

The sulfopolyesters of the instant invention are readily prepared from the appropriate dicarboxylic acids, esters, anhydrides, salts, sulfomonomer, and the appropriate diol or diol mixtures using typical polycondensation reaction conditions. They may be made by continuous, semi-continuous, and batch modes of operation and may utilize a variety of reactor types. Examples of suitable reactor types include, but are not limited to, stirred tank, continuous stirred tank, slurry, tubular, wiped-film, falling film, or extrusion reactors. The term "continuous" as used herein means a process wherein reactants are introduced and products withdrawn simultaneously in an uninterrupted manner. By "continuous" it is meant that the process is substantially or completely continuous in operation and is to be contrasted with a "batch" process. "Continuous" is not meant in any way to prohibit normal interruptions in the continuity of the process due to, for example, start-up, reactor maintenance, or scheduled shut down periods. The term "batch" process as used herein means a process wherein all the reactants are added to the reactor and then processed according to a predetermined course of reaction during which no material is fed or removed from the reactor. The term "semicontinuous" means a process where some of the reactants are charged at the beginning of the process and the remaining reactants are fed continuously as the reaction progresses. Alternatively, a semicontinuous process may also include a process similar to a batch process in which all the reactants are added at the beginning of the process except that one or more of the products are removed continuously as the reaction progresses. The process is operated advantageously as a continuous process for economic reasons and to produce superior coloration of the polymer as the sulfopolyester may deteriorate in appearance if allowed to reside in a reactor at an elevated temperature for too long a duration.

The sulfopolyesters can be prepared by procedures known to persons skilled in the art. The sulfomonomer is most often added directly to the reaction mixture from which the polymer is made, although other processes are known and may also be employed, for example, as described in U.S. Pat. No. 3,018,272, U.S. Pat. No. 3,075,952, and U.S. Pat. No. 3,033,822. The reaction of the sulfomonomer, diol component, and the dicarboxylic acid component may be carried out using conventional polyester polymerization conditions. For example, when preparing the sulfopolyesters by means of an ester interchange reaction, i.e., from the ester form of the dicarboxylic acid components, the reaction process may comprise two steps. In the first step, the diol component and the dicarboxylic acid component, such as, for example, dimethyl isophthalate, are reacted at elevated temperatures of about 150° C. to about 250° C. for about 0.5 to 8 hours at pressures ranging from about 0.0 kPa gauge to about 414 kPa gauge (60 pounds per square inch, "psig"). Preferably, the temperature for the ester interchange reaction ranges from about 180° C. to about 230° C. for about 1 to 4 hours while the preferred pressure ranges from about 103 kPa gauge (15 psig) to about 276 kPa gauge (40 psig). Thereafter, the reaction product is heated under higher temperatures and under reduced pressure to form a sulfopolyester with the elimination of a diol, which is readily volatilized under these conditions and removed from the system. This second step, or polycondensation step, is continued under higher vacuum conditions and a temperature which generally ranges from about 230° C. to about 350° C., preferably about 250° C. to about 310° C., and most preferably about 260° C. to about 290° C. for about 0.1 to about 6 hours, or preferably, for about 0.2 to about 2 hours, until a polymer having the desired degree of polymerization, as determined by inherent viscosity, is obtained. The polycondensation step may be conducted under reduced pressure which ranges from about 53 kPa (400 torr) to about 0.013 kPa (0.1 torr). Stirring or appropriate conditions are used in both stages to ensure adequate heat transfer and surface renewal of the reaction mixture. The reactions of both stages are facilitated by appropriate catalysts such as, for example, alkoxy titanium compounds, alkali metal hydroxides and alcoholates, salts of organic carboxylic acids, alkyl tin compounds, metal oxides, and the like. A three-stage manufacturing procedure, similar to that described in U.S. Pat. No. 5,290,631 may also be used, particularly when a mixed monomer feed of acids and esters is employed.

To ensure that the reaction of the diol component and dicarboxylic acid component by an ester interchange reaction mechanism is driven to completion, it is preferred to employ about 1.05 to about 2.5 moles of diol component to one mole of dicarboxylic acid component. Persons of skill in the art will understand, however, that the ratio of diol component to dicarboxylic acid component is generally determined by the design of the reactor in which the reaction process occurs.

In the preparation of sulfopolyester by direct esterification, i.e., from the acid form of the dicarboxylic acid component, sulfopolyesters are produced by reacting the dicarboxylic acid or a mixture of dicarboxylic acids with the diol component or a mixture of diol components. The reaction is conducted at a pressure of from about 7 kPa gauge (1 psig) to about 1,379 kPa gauge (200 psig), preferably less than 689 kPa (100 psig) to produce a low molecular weight, linear or branched sulfopolyester product having an average degree of polymerization of from about 1.4 to about 10. The temperatures employed during the direct esterification reaction typically range from about 180° C. to about 280° C., more preferably ranging from about 220° C. to about 270° C. This low molecular weight polymer may then be polymerized by a polycondensation reaction.

As noted hereinabove, the sulfopolyesters are advantageous for the preparation of bicomponent and multicomponent fibers having a shaped cross section. We have discovered that sulfopolyesters or blends of sulfopolyesters having a glass transition temperature (Tg) of at least 35° C. are particularly useful for multicomponent fibers for preventing blocking and fusing of the fiber during spinning and take up. Further, to obtain a sulfopolyester with a Tg of at least 35° C., blends of one or more sulfopolyesters may be used in varying proportions to obtain a sulfopolyester blend having the desired Tg. The Tg of a sulfopolyester blend may be calculated by using a weighted average of the Tg's of the sulfopolyester components. For example, sulfopolyesters having a Tg of 48° C. may be blended in a 25:75 weight: weight ratio with another sulfopolyester having Tg of 65° C. to give a sulfopolyester blend having a Tg of approximately 61° C.

In another embodiment of the invention, the water dispersible sulfopolyester component of the multicomponent fiber presents properties which allow at least one of the following:

(a) the multicomponent fibers to be spun to a desired low denier, (b) the sulfopolyester in these multicomponent fibers to be resistant to removal during hydroentangling of a web formed from the multicomponent fibers but is efficiently removed at elevated temperatures after hydroentanglement, and (c) the multicomponent fibers to be heat settable so as to yield a stable, strong fabric. Surprising and unexpected results were achieved in furtherance of these objectives using a sulfopolyester having a certain melt viscosity and level of sulfomonomer residues.

As previously discussed, the sulfopolyester or sulfopolyester blend utilized in the multicomponent fibers can have a melt viscosity of generally less than about 12,000, 10,000, 6,000, or 4,000 poise as measured at 240° C. and at a 1 rad/sec shear rate. In another aspect, the sulfopolyester or sulfopolyester blend exhibits a melt viscosity of between about 1,000 to 12,000 poise, more preferably between 2,000 to 6,000 poise, and most preferably between 2,500 to 4,000 poise measured at 240° C. and at a 1 rad/sec shear rate. Prior to determining the viscosity, the samples are dried at 60° C. in a vacuum oven for 2 days. The melt viscosity is measured on a rheometer using 25 mm diameter parallel-plate geometry at a 1 mm gap setting. A dynamic frequency sweep is run at a strain rate range of 1 to 400 rad/sec and 10 percent strain amplitude. The viscosity is then measured at 240° C. and at a strain rate of 1 rad/sec.

The level of sulfomonomer residues in the sulfopolyester polymers is at least 4 or 5 mole percent and less than about 25, 20, 12, or 10 mole percent, reported as a percentage of the total diacid or diol residues in the sulfopolyester. Sulfomonomers for use with the invention preferably have 2 functional groups and one or more sulfonate groups attached to an aromatic or cycloaliphatic ring wherein the functional groups are hydroxyl, carboxyl, or a combination thereof. A sodiosulfo-isophthalic acid monomer is particularly preferred.

In addition to the sulfomonomer described previously, the sulfopolyester preferably comprises residues of one or more dicarboxylic acids, one or more diol residues wherein at least 25 mole percent, based on the total diol residues, is a poly(ethylene glycol) having a structure $H—(OCH_2—CH_2)_n—OH$ wherein n is an integer in the range of 2 to about 500, and 0 to about 20 mole percent, based on the total repeating units, of residues of a branching monomer having 3 or more functional groups wherein the functional groups are hydroxyl, carboxyl, or a combination thereof.

In a particularly preferred embodiment, the sulfopolyester comprises from about 60 to 99, 80 to 96, or 88 to 94 mole percent of dicarboxylic acid residues, from about 1 to 40, 4 to 20, or 6 to 12 mole percent of sulfomonomer residues, and 100 mole percent of diol residues (there being a total mole percent of 200 percent, i.e., 100 mole percent diacid and 100 mole percent diol). More specifically, the dicarboxylic portion of the sulfopolyester comprises between about 50 to 95, 60 to 80, or 65 to 75 mole percent of terephthalic acid, about 0.5 to 49, 1 to 30, or 15 to 25 mole percent of isophthalic acid, and about 1 to 40, 4 to 20, or 6 to 12 mole percent of 5-sodiosulfoisophthalic acid (5-SSIPA). The diol portion comprises from about 0 to 50 mole percent of diethylene glycol and from about 50 to 100 mole percent of ethylene glycol. An exemplary formulation according to this embodiment of the invention is set forth subsequently.

| | Approximate Mole percent (based on total moles of diol or diacid residues) |
|---|---|
| Terephthalic acid | 71 |
| Isophthalic acid | 20 |
| 5-SSIPA | 9 |
| Diethylene glycol | 35 |
| Ethylene glycol | 65 |

The water dispersible component of the multicomponent fibers of the nonwoven web may consist essentially of or, consist of, the sulfopolyesters described hereinabove. In another embodiment, however, the sulfopolyesters of this invention may be blended with one or more supplemental polymers to modify the properties of the resulting multicomponent fiber. The supplemental polymer may be miscible or immiscible with the sulfopolyester. The term "miscible," as used herein, is intended to mean that the blend has a single, homogeneous amorphous phase as indicated by a single composition-dependent Tg. For example, a first polymer that is miscible with second polymer may be used to "plasticize" the second polymer as illustrated, for example, in U.S. Pat. No. 6,211,309. By contrast, the term "immiscible," as used herein, denotes a blend that shows at least two randomly mixed phases and exhibits more than one Tg. Some polymers may be immiscible and yet compatible with the sulfopolyester. A further general description of miscible and immiscible polymer blends and the various analytical techniques for their characterization may be found in Polymer Blends Volumes 1 and 2, Edited by D. R. Paul and C. B. Bucknall, 2000, John Wiley & Sons, Inc, the disclosure of which is incorporated herein by reference.

Non-limiting examples of water-dispersible polymers that may be blended with the sulfopolyester are polymethacrylic acid, polyvinyl pyrrolidone, polyethylene-acrylic acid copolymers, polyvinyl methyl ether, polyvinyl alcohol, polyethylene oxide, hydroxy propyl cellulose, hydroxypropyl methyl cellulose, methyl cellulose, ethyl hydroxyethyl cellulose, isopropyl cellulose, methyl ether starch, polyacrylamides, poly(N-vinyl caprolactam), polyethyl oxazoline, poly(2-isopropyl-2-oxazoline), polyvinyl methyl oxazolidone, water-dispersible sulfopolyesters, polyvinyl methyl oxazolidimone, poly(2,4-dimethyl-6-triazinylethylene), and ethylene oxide-propylene oxide copolymers.

According to our invention, blends of more than one sulfopolyester may be used to tailor the end-use properties of the resulting multicomponent fiber or nonwoven web. The blends of one or more sulfopolyesters will have Tg's of at least 35° C. for the multicomponent fibers.

The sulfopolyester and supplemental polymer may be blended in batch, semicontinuous, or continuous processes. Small scale batches may be readily prepared in any high-intensity mixing devices well known to those skilled in the art, such as Banbury mixers, prior to melt-spinning fibers. The components may also be blended in solution in an appropriate solvent. The melt blending method includes blending the sulfopolyester and supplemental polymer at a temperature sufficient to melt the polymers. The blend may be cooled and pelletized for further use or the melt blend can be melt spun directly from this molten blend into fiber form. The term "melt" as used herein includes, but is not limited to, merely softening the polyester. For melt mixing methods generally known in the polymers art, see Mixing and Compounding of Polymers (I. Manas-Zloczower & Z. Tadmor editors, Carl Hanser Verlag Publisher, 1994, New York, N.Y.).

The water non-dispersible components of the multicomponent fibers, the binder microfibers, and the nonwoven webs of this invention also may contain other conventional additives and ingredients which do not deleteriously affect their end use. For example, additives include, but are not limited to, starches, fillers, light and heat stabilizers, antistatic agents, extrusion aids, dyes, anticounterfeiting markers, slip agents, tougheners, adhesion promoters, oxidative stabilizers, UV absorbers, colorants, pigments, opacifiers (delustrants), optical brighteners, fillers, nucleating agents, plasticizers, viscosity modifiers, surface modifiers, antimicrobials, antifoams, lubricants, thermostabilizers, emulsifiers, disinfectants, cold flow inhibitors, branching agents, oils, waxes, and catalysts.

In one embodiment of the invention, the multicomponent fibers, the binder microfibers, and nonwoven webs will contain less than 10 weight percent of anti-blocking additives, based on the total weight of the multicomponent fiber or nonwoven web. For example, the multicomponent fiber or nonwoven web may contain less than 10, 9, 5, 3, or 1 weight percent of a pigment or filler based on the total weight of the multicomponent fiber or nonwoven web. Colorants, sometimes referred to as toners, may be added to impart a desired neutral hue and/or brightness to the water non-dispersible polymer. When colored fibers are desired, pigments or colorants may be included when producing the water non-dispersible polymer or they may be melt blended with the preformed water non-dispersible polymer. A preferred method of including colorants is to use a colorant having thermally stable organic colored compounds having reactive groups such that the colorant is copolymerized and incorporated into the sulfopolyester to improve its hue. For example, colorants such as dyes possessing reactive hydroxyl and/or carboxyl groups, including, but not limited to, blue and red substituted anthraquinones, may be copolymerized into the polymer chain.

As previously discussed, the segments or domains of the multicomponent fibers may comprise one or more water non-dispersible synthetic polymers. Examples of water non-dispersible synthetic polymers which may be used in segments of the multicomponent fiber include, but are not limited to, polyolefins, polyesters, copolyesters, polyamides, polylactides, polycaprolactone, polycarbonate, polyurethane, acrylics, cellulose ester, and/or polyvinyl chloride. For example, the water non-dispersible synthetic polymer may be polyester such as polyethylene terephthalate homopolymer, polyethylene terephthalate copolymer, polybutylene terephthalate, polycyclohexylene cyclohexanedicarboxylate, polycyclohexylene terephthalate, polytrimethylene terephthalate, and the like. As in another example, the water non-dispersible synthetic polymer can be biodistintegratable as determined by DIN Standard 54900 and/or biodegradable as determined by ASTM Standard Method, D6340-98. Examples of biodegradable polyesters and polyester blends are disclosed in U.S. Pat. No. 5,599,858; U.S. Pat. No. 5,580,911; U.S. Pat. No. 5,446,079; and U.S. Pat. No. 5,559,171.

The term "biodegradable," as used herein in reference to the water non-dispersible synthetic polymers, is understood to mean that the polymers are degraded under environmental influences such as, for example, in a composting environment, in an appropriate and demonstrable time span as defined, for example, by ASTM Standard Method, D6340-98, entitled "Standard Test Methods for Determining Aerobic Biodegradation of Radiolabeled Plastic Materials in an Aqueous or Compost Environment." The water non-dispersible synthetic polymers of the present invention also may be "biodisintegratable," meaning that the polymers are easily fragmented in a composting environment as defined, for example, by DIN Standard 54900. For example, the biodegradable polymer is initially reduced in molecular weight in the environment by the action of heat, water, air, microbes, and other factors. This reduction in molecular weight results in a loss of physical properties (tenacity) and often in fiber breakage. Once the molecular weight of the polymer is sufficiently low, the monomers and oligomers are then assimilated by the microbes. In an aerobic environment, these monomers or oligomers are ultimately oxidized to $CO_2$, $H_2O$, and new cell biomass. In an anaerobic environment, the monomers or oligomers are ultimately converted to $CO_2$, $H_2$, acetate, methane, and cell biomass.

Additionally, the water non-dispersible synthetic polymers may comprise aliphatic-aromatic polyesters, abbreviated herein as "AAPE." The term "aliphatic-aromatic polyester," as used herein, means a polyester comprising a mixture of residues from aliphatic dicarboxylic acids, cycloaliphatic dicarboxylic acids, aliphatic diols, cycloaliphatic diols, aromatic diols, and aromatic dicarboxylic acids. The term "non-aromatic," as used herein with respect to the dicarboxylic acid and diol monomers of the present invention, means that carboxyl or hydroxyl groups of the monomer are not connected through an aromatic nucleus. For example, adipic acid contains no aromatic nucleus in its backbone (i.e., the chain of carbon atoms connecting the carboxylic acid groups), thus adipic acid is "non-aromatic." By contrast, the term "aromatic" means the dicarboxylic acid or diol contains an aromatic nucleus in its backbone such as, for example, terephthalic acid or 2,6-naphthalene dicarboxylic acid. "Non-aromatic," therefore, is intended to include both aliphatic and cycloaliphatic structures such as, for example, diols and dicarboxylic acids, which contain as a backbone a straight or branched chain or cyclic arrangement of the constituent carbon atoms which may be saturated or paraffinic in nature, unsaturated (i.e., containing non-aromatic carbon-carbon double bonds), or acetylenic (i.e., containing carbon-carbon triple bonds). Thus, non-aromatic is intended to include linear and branched, chain structures (referred to herein as "aliphatic") and cyclic structures (referred to herein as "alicyclic" or "cycloaliphatic"). The term "non-aromatic," however, is not intended to exclude any aromatic substituents which may be attached to the backbone of an aliphatic or cycloaliphatic diol or dicarboxylic acid. In the present invention, the difunctional carboxylic acid typically is a aliphatic dicarboxylic acid such as, for example, adipic acid, or an aromatic dicarboxylic acid such as, for example, terephthalic acid. The difunctional hydroxyl compound may be cycloaliphatic diol such as, for example, 1,4-cyclohexanedimethanol, a linear or branched aliphatic diol such as, for example, 1,4-butanediol, or an aromatic diol such as, for example, hydroquinone.

The AAPE may be a linear or branched random copolyester and/or chain extended copolyester comprising diol residues which comprise the residues of one or more substituted or unsubstituted, linear or branched, diols selected from aliphatic diols containing 2 to 8 carbon atoms, polyalkylene ether glycols containing 2 to 8 carbon atoms, and cycloaliphatic diols containing about 4 to about 12 carbon atoms. The substituted diols, typically, will comprise 1 to 4 substituents independently selected from halo, $C_6$-$C_{10}$ aryl, and $C_1$-$C_4$ alkoxy. Examples of diols which may be used include, but are not limited to, ethylene glycol, diethylene glycol, propylene glycol, 1,3-propanediol, 2,2-dimethyl-1,3-propanediol, 1,3-butanediol, 1,4-butanediol, 1,5-pentanediol, 1,6-hexanediol, polyethylene glycol, diethylene glycol, 2,2,4-trimethyl-1,6-hexanediol, thiodiethanol, 1,3-cyclohexanedimethanol, 1,4-cyclohexanedimethanol, 2,2,4,4-tetramethyl-1,3-cyclobutanediol, triethylene glycol, and tetraethylene glycol. The AAPE also comprises diacid residues which contain about 35 to about 99 mole percent, based on the total moles of diacid residues, of the residues of one or more substituted or unsubstituted, linear or branched, non-aromatic dicarboxylic acids selected from aliphatic dicarboxylic acids containing 2 to 12 carbon atoms and cycloaliphatic acids containing about 5 to 10 carbon atoms. The substituted non-aromatic dicarboxylic acids will typically contain 1 to about 4 substituents selected from halo, $C_6$-$C_{10}$ aryl, and $C_1$-$C_4$ alkoxy. Non-limiting examples of non-aromatic diacids include malonic, succinic, glutaric, adipic, pimelic, azelaic, sebacic, fumaric, 2,2-dimethyl glutaric, suberic, 1,3-cyclopentanedicarboxylic, 1,4-cyclohexanedicarboxylic, 1,3-cyclohexanedicarboxylic, diglycolic, itaconic, maleic, and 2,5-norbornane-dicarboxylic. In addition to the non-aromatic dicarboxylic acids, the AAPE comprises about 1 to about 65 mole percent, based on the total moles of diacid residues, of the residues of one or more substituted or unsubstituted aromatic dicarboxylic acids containing 6 to about 10 carbon atoms. In the case where substituted aromatic dicarboxylic acids are used, they will typically contain 1 to about 4 substituents selected from halo, $C_6$-$C_{10}$ aryl, and $C_1$-$C_4$ alkoxy. Non-limiting examples of aromatic dicarboxylic acids which may be used in the AAPE of our invention are terephthalic acid, isophthalic acid, salts of 5-sulfoisophthalic acid, and 2,6-naphthalenedicarboxylic acid. More preferably, the non-aromatic dicarboxylic acid will comprise adipic acid, the aromatic dicarboxylic acid will comprise terephthalic acid, and the diol will comprise 1,4-butanediol.

Other possible compositions for the AAPE are those prepared from the following diols and dicarboxylic acids (or polyester-forming equivalents thereof such as diesters) in the following mole percentages, based on 100 mole percent of a diacid component and 100 mole percent of a diol component:

(1) glutaric acid (about 30 to about 75 mole percent), terephthalic acid (about 25 to about 70 mole percent), 1,4-butanediol (about 90 to 100 mole percent), and modifying diol (0 about 10 mole percent);
(2) succinic acid (about 30 to about 95 mole percent), terephthalic acid (about 5 to about 70 mole percent), 1,4-butanediol (about 90 to 100 mole percent), and modifying diol (0 to about 10 mole percent); and
(3) adipic acid (about 30 to about 75 mole percent), terephthalic acid (about 25 to about 70 mole percent), 1,4-butanediol (about 90 to 100 mole percent), and modifying diol (0 to about 10 mole percent).

The modifying diol preferably is selected from 1,4-cyclohexanedimethanol, triethylene glycol, polyethylene glycol, and neopentyl glycol. The most preferred AAPEs are linear, branched, or chain extended copolyesters comprising about 50 to about 60 mole percent adipic acid residues, about 40 to about 50 mole percent terephthalic acid residues, and at least 95 mole percent 1,4-butanediol residues. Even more preferably, the adipic acid residues comprise about 55 to about 60 mole percent, the terephthalic acid residues comprise about 40 to about 45 mole percent, and the diol residues comprise about 95 mole percent 1,4-butanediol residues. Such compositions are commercially available under the trademark ECOFLEX® from BASF Corporation.

Additional, specific examples of preferred AAPEs include a poly(tetramethylene glutarate-co-terephthalate) containing (a) 50 mole percent glutaric acid residues, 50 mole percent terephthalic acid residues, and 100 mole percent 1,4-butanediol residues, (b) 60 mole percent glutaric acid residues, 40 mole percent terephthalic acid residues, and 100 mole percent 1,4-butanediol residues, or (c) 40 mole percent glutaric acid residues, 60 mole percent terephthalic acid residues, and 100 mole percent 1,4-butanediol residues; a poly(tetramethylene succinate-co-terephthalate) containing (a) 85 mole percent succinic acid residues, 15 mole percent terephthalic acid residues, and 100 mole percent 1,4-butanediol residues or (b) 70 mole percent succinic acid residues, 30 mole percent terephthalic acid residues, and 100 mole percent 1,4-butanediol residues; a poly(ethylene succinate-co-terephthalate) containing 70 mole percent succinic acid residues, 30 mole percent terephthalic acid residues, and 100 mole percent ethylene glycol residues; and a poly(tetramethylene adipate-co-terephthalate) containing (a) 85 mole percent adipic acid residues, 15 mole percent terephthalic acid residues, and 100 mole percent 1,4-butanediol residues; or (b) 55 mole percent adipic acid residues, 45 mole percent terephthalic acid residues, and 100 mole percent 1,4-butanediol residues.

The AAPE preferably comprises from about 10 to about 1,000 repeating units and preferably, from about 15 to about 600 repeating units. The AAPE may have an inherent viscosity of about 0.4 to about 2.0 dL/g, or more preferably about 0.7 to about 1.6 dL/g, as measured at a temperature of 25° C. using a concentration of 0.5 g copolyester in 100 ml of a 60/40 by weight solution of phenol/tetrachloroethane.

The AAPE, optionally, may contain the residues of a branching agent. The mole percent ranges for the branching agent are from about 0 to about 2 mole percent, preferably about 0.1 to about 1 mole percent, and most preferably about 0.1 to about 0.5 mole percent based on the total moles of diacid or diol residues (depending on whether the branching agent contains carboxyl or hydroxyl groups). The branching agent preferably has a weight average molecular weight of about 50 to about 5,000, more preferably about 92 to about 3,000, and a functionality of about 3 to about 6. The branching agent, for example, may be the esterified residue of a polyol having 3 to 6 hydroxyl groups, a polycarboxylic acid having 3 or 4 carboxyl groups (or ester-forming equivalent groups), or a hydroxy acid having a total of 3 to 6 hydroxyl and carboxyl groups. In addition, the AAPE may be branched by the addition of a peroxide during reactive extrusion.

The water non-dispersible component of the multicomponent fiber may comprise any of those water non-dispersible synthetic polymers described previously. Spinning of the fiber may also occur according to any method described herein. However, the improved rheological properties of the multicomponent fibers in accordance with this aspect of the invention provide for enhanced drawings speeds. When the sulfopolyester and water non-dispersible synthetic polymer are extruded to produce multicomponent extrudates, the multicomponent extrudate is capable of being melt drawn to produce the multicomponent fiber, using any of the methods disclosed herein, at a speed of at least about 2,000, 3,000, 4,000, or 4,500 m/min. Although not intending to be bound by theory, melt drawing of the multicomponent extrudates at these speeds results in at least some oriented crystallinity in the water non-dispersible component of the multicomponent fiber. This oriented crystallinity can increase the dimensional stability of nonwoven materials made from the multicomponent fibers during subsequent processing.

Another advantage of the multicomponent extrudate is that it can be melt drawn to a multicomponent fiber having an as-spun denier of less than 15, 10, 5 or 2.5 deniers per filament.

Therefore, in another embodiment of the invention, a multicomponent extrudate having a shaped cross section, comprising:

(a) at least one water dispersible sulfopolyester; and (b) a plurality of domains comprising one or more water non-dispersible synthetic polymers immiscible with the sulfopolyester, wherein the domains are substantially isolated from each other by the sulfopolyester intervening between the domains, wherein the extrudate is capable of being melt drawn at a speed of at least about 2000 m/min.

Optionally, the drawn fibers may be textured and wound-up to form a bulky continuous filament. This one-step technique is known in the art as spin-draw-texturing. Other embodiments include flat filament (non-textured) yarns, or cut staple fiber, either crimped or uncrimped.

The binder microfibers can be incorporated into a number of different fibrous articles. The binder microfibers can be incorporated into fibrous articles such as personal care products, medical care products, automotive products, household products, personal recreational products, specialty papers, paper products, and building and landscaping materials. Additionally or alternatively, the binder microfibers can be incorporated into fibrous articles such as nonwoven webs, thermobonded webs, hydroentangled webs, multilayer nonwovens, laminates, composites, wet-laid webs, dry-laid webs, wet laps, woven articles, fabrics, and geotextiles. Laminates can include for example high pressure laminates and decorative laminates.

Examples of personal care products include feminine napkins, panty liners, tampons, diapers, adult incontinence briefs, gauze, disposable wipes, baby wipes, toddler wipes, hand and body wipes, nail polish removal wipes, tissues, training pants, sanitary napkins, bandages, toilet paper, cosmetic applicators, and perspiration shields.

Examples of medical care products include medical wipes, tissues, gauzes, examination bed coverings, surgical masks, gowns, bandages, surgical dressings, protective layers, absorbent top sheets, tapes, surgical drapes, terminally sterilized medical packages, thermal blankets, therapeutic pads, and wound dressings.

Examples of automotive products include automotive body compounds, clear tank linings, automotive wipes, gaskets, molded interior parts, tire sealants, and undercoatings.

Examples of personal recreation products include acoustical media, audio speaker cones, and sleeping bags.

Examples of household products include cleaning wipes, floor cleaning wipes, dusting and polishing wipes, fabric softener sheets, lampshades, ovenable boards, food wrap, drapery headers, food warmers, seat cushions, bedding, paper towels, cleaning gloves, humidifiers, and ink cartridges.

Examples of specialty papers include packaging materials, flexible packaging, aseptic packaging, liquid packaging board, tobacco packaging, pouch and packet, grease resistant packaging, cardboard, recycled cardboard, food packaging material, battery separators, security papers, paper-board, labels, envelopes, multiwall bags, capacitor papers, artificial leather covers, electrical papers, heat sealing papers, recyclable labels for plastic containers, sandpaper backing, vinyl floor backing, and wallpaper backing.

Examples of paper products include papers, repulpable paper products, printing and publishing papers, currency papers, gaming and lottery papers, bank notes, checks, water and tear resistant printing papers, trade books, banners, maps and charts, opaque papers, carbonless papers, high strength paper, and art papers.

Examples of building and landscaping materials include laminating adhesives, protective layers, binders, concrete reinforcement, cements, flexible preform for compression molded composites, electrical materials, thermal insulation, weed barriers, irrigation articles, erosion barriers, seed support media, agricultural media, housing envelopes, transformer boards, cable wrap and fillers, slot insulations, moisture barrier film, gypsum board, wallpaper, asphalt, roofing underlayment, decorative materials, block fillers, bonders, caulks, sealants, flooring materials, grouts, marine coatings, mortars, protective coatings, roof coatings, roofing materials, storage tank linings, stucco, textured coatings, asphalt, epoxy adhesive, concrete slabs, overlays, curtain linings, pipe wraps, oil absorbers, rubber reinforcement, vinyl ester resins, boat hull substrates, computer disk liners, and condensate collectors.

Examples of fabrics include yarns, artificial leathers, suedes, personal protection garments, apparel inner linings, footwear, socks, boots, pantyhose, shoes, insoles, biocidal textiles, and filter media.

The binder microfibers can be used to produce a wide array of filter media. For instance, the filter media can include filter media for air filtration, filter media for water filtration, filter media for solvent filtration, filter media for hydrocarbon filtration, filter media for oil filtration, filter media for fuel filtration, filter media for paper making processes, filter media for food preparation, filter media for medical applications, filter media for bodily fluid filtration, filter media for blood, filter media for clean rooms, filter media for heavy industrial equipment, filter media for milk and potable water, filter media for recycled water, filter media for desalination, filter media for automotives, HEPA filters, ULPA filters, coalescent filters, liquid filters, coffee and tea bags, vacuum dust bags, and water filtration cartridges.

As described previously, the fibrous articles also may include various powders and particulates to improve absorbency or as delivery vehicles. Thus, in one embodiment, our fibrous article comprises a powder comprising a third water-dispersible polymer that may be the same as or different from the water-dispersible polymer components described previously herein. Other examples of powders and particulates include, but are not limited to, talc, starches, various water absorbent, water-dispersible, or water swellable polymers, such as poly(acrylonitiles), sulfopolyesters, and poly (vinyl alcohols), silica, pigments, and microcapsules.

EXAMPLES

Test Methods

Performance evaluations of the nonwovens disclosed herein were conducted using the following methods:

Permeability—ASTM D737

Burst Strengths—ISO 2758, TAPPI 403 (Dry Burst sample preparation per std. Wet Burst sample preparation included soaking specimen in 83±2° C. tap water for 5 minutes and blotting it before testing)

Dry Tensile Strength—TAPPI 494

Wet Tensile Strength—TAPPI 456 with slight modification in that testing temperature was increased from the 23±2° C. standard to 83±20.

Air Resistance and Penetration was determined by ASTM F1471-09 using TSI 8130 test equipment.

Example 1

A sulfopolyester polymer was prepared with the following diacid and diol composition: diacid composition (69 mole percent terephthalic acid, 22.5 mole percent isophthalic 25 acid, and 8.5 mole percent 5-(sodiosulfo)isophthalic acid) and diol composition (65 mole percent ethylene glycol and 35 mole percent diethylene glycol). The sulfopolyester was prepared by high temperature polyesterification under a vacuum. The esterification conditions were controlled to produce a sulfopolyester having an inherent viscosity of about 0.33. The melt viscosity of this sulfopolyester was measured to be in the range of about 6000 to 7000 poise at 240° C. and 1 rad/sec shear rate.

Example 2

The sulfopolyester polymer of Example 1 was spun into bicomponent islands-in-the-sea cross-section fibers using a bicomponent extrusion line. The primary extruder (A) fed Eastman F61 HC PET polyester to form the "islands" in the islands-in-the-sea cross-section structure. The secondary extruder (B) fed the water dispersible sulfopolyester polymer to form the "sea" in the islands-in-sea bicomponent fiber. The inherent viscosity of the polyester was 0.61 dL/g while the melt viscosity of the dry sulfopolyester was about 7,000 poise measured at 240° C. and 1 rad/sec strain rate using the melt viscosity measurement procedure described previously. The polymer ratio between "islands" polyester and "sea" sulfopolyester was 2.33 to 1. The filaments of the bicomponent fiber were then drawn in line using a set of two godet rolls to provide a filament draw ratio of about 3.3×, thus forming the drawn islands-in-sea bicomponent filaments with a nominal denier per filament of about 5.0. These filaments comprised the polyester microfiber islands having an average diameter of about 2.5 microns. The drawn islands-in-sea bicomponent fibers were then cut into short length bicomponent fibers of 1.5 millimeters cut length and then washed using soft water at 80° C. to remove the water dispersible sulfopolyester "sea" component, thereby releasing the polyester microfibers which were the "islands" component of the bicomponent fibers. The washed polyester microfibers were rinsed using soft water at 25° C. to essentially remove most of the "sea" component. The optical microscopic observation of the washed polyester microfibers had an average diameter of about 2.5 microns and a length of 1.5 millimeters.

Example 3

The sulfopolyester polymer of Example 1 was spun into bicomponent islands-in-the-sea cross-section fibers using a bicomponent extrusion line. The primary extruder (A) fed Eastman F61 HC PET polyester to form the "islands" in the islands-in-the-sea cross-section structure. The secondary extruder (B) fed the water dispersible sulfopolyester polymer to form the "sea" in the islands-in-sea bicomponent fiber. The inherent viscosity of the polyester was 0.61 dL/g while the melt viscosity of the dry sulfopolyester was about 7,000 poise measured at 240° C. and 1 rad/sec strain rate using the melt viscosity measurement procedure described previously. The polymer ratio between "islands" polyester and "sea" sulfopolyester was 2.33 to 1. The filaments of the bicomponent fiber were then drawn in line using a set of two godet rolls to provide a filament draw ratio of about 3.3×. These filaments comprised the polyester microfiber islands having an average diameter of about 5.0 microns. The drawn islands-in-sea bicomponent fibers were then cut into short length bicomponent fibers of 3.0 millimeters cut length and then washed using soft water at 80° C. to remove the water dispersible sulfopolyester "sea" component, thereby releasing the polyester microfibers which were the "islands" component of the bicomponent fibers. The washed polyester microfibers were rinsed using soft water at 25° C. to essentially remove most of the "sea" component. The optical microscopic observation of the washed polyester microfibers had an average diameter of about 5.0 microns and a length of 3.0 millimeters.

Example 4

Following the general procedures outlined in Example 2, 2.5 micron diameter, 1.5 mm long synthetic polymeric microfiber composed of the Eastman copolyester TX1000 were prepared.

Example 5

Following the general procedures outlined in Example 2, 2.5 micron diameter, 3.0 mm long synthetic polymeric microfiber composed of the Eastman copolyester TX1000 were prepared.

Example 6

Following the general procedures outlined in Example 2, 2.5 micron diameter, 1.5 mm long synthetic polymeric microfiber composed of the Eastman copolyester TX1500 were prepared.

Example 7

Following the general procedures outlined in Example 2, 2.5 micron diameter, 1.5 mm long synthetic polymeric microfibers composed of the Eastman copolyester Eastar 14285 were prepared.

Example 8

Following the general procedures outlined in Example 2, 2.5 micron diameter, 1.5 mm long synthetic polymeric microfibers composed of the Eastman copolyester Durastar 1000 were prepared.

Example 9

Wet-laid handsheets were prepared using the following procedure. To attain a complete dispersion of the fibers in the handsheet formulation, each fiber in that formulation was dispersed separately by agitation in a modified blender for 1 to 2 minutes, at a consistency not more than 0.2 percent. The disperse fibers were transferred into a 20 liter mixing vat containing 10 liters of water with constant mixing for 5 to 10 minutes. The fiber slurry in the mixing vat was poured into a square handsheet mold with a removable 200 mesh screen, which was half-filled with water while continuing to stir. The remainder of the volume of the handsheet mold was filled with water, and the drop valve was pulled, allowing the fibers to drain on the mesh screen to form a hand sheet. Excess water in the handsheet was removed by sliding the bottom of the steel mesh over vacuum slots two or three times. The damp handsheet was then transferred onto a Teflon coated woven glass fiber mesh and placed between a drying felt and drying drum. The handsheet was allowed to dry for 10 minutes at 150° C. The dried handsheet was transferred and placed between two hot plates, where it was heated for 5 minutes at 170° C. to fully activate the binder fibers. The physical properties of the handsheets were measured and are reported in the following graphs.

Example 10

Following the general procedure outlined in Example 9, the synthetic polymeric microfiber of Example 2 was blended with varying weight fractions of synthetic binder fibers selected from those previously described in these Examples to yield approximately 60 gram per square meter handsheets. The compositions and characteristics of the binder microfiber-containing handsheets are described below in Table 1.

Example 11

Following the general procedure outlined in Example 9, the synthetic polymeric microfiber of Example 3 was blended with the synthetic polymeric binder microfiber of Example 6 at varying weight fractions to yield approximately 60 gram per square meter handsheets. The compositions and characteristics of the binder microfiber-containing handsheets are described below in Table 2.

Example 12

Following the general procedure outlined in Example 9, synthetic binder fibers selected from those previously described were blended in varying ratios with 0.6 micron diameter glass microfibers (Microstrand 106X from Johns Manville and B-06-F from Lauscha Fibers International) to yield approximately 60 gram per square meter handsheets. The compositions and characteristics of the binder microfiber-containing handsheets are described below in Table 3.

Example 13

Following the general procedure outlined in Example 9, synthetic binder fibers selected from those previously described were blended in varying ratios of a cellulosic pulp (Albacel refined to a Schopper-Riegler freeness of 50) to yield approximately 60 gram per square meter handsheets. The compositions and characteristics of the binder microfiber-containing handsheets are described below in Table 4.

Example 14

Following the general procedure outlined in Example 9, a synthetic polymer microfiber similar to that of Example 2 but with a 4.5 micron diameter was blended with the synthetic binder microfiber of Example 6 at a ratio of 1:1 to yield an approximately 4 gram per square meter handsheet. The dry tensile strength (break force) of this handsheet was 117 gF and the permeability was 610 $ft^3/ft/min$. A scanning electron micrograph of the resulting handsheet is shown in FIG. 1.

TABLE 1

| Binder Fiber | | Permeability | Tensile (gF) | | Burst (psi) | |
|---|---|---|---|---|---|---|
| Type | wt % | $ft^3/ft/min$ | dry | wet | dry | wet |
| Example 5 | 10 | 8.6 | 1545 | 653 | 24.8 | 6.1 |
| | 15 | 8.4 | 1588 | 597 | 28.1 | 7.7 |
| | 30 | 8.9 | 3147 | 1476 | 39.6 | 19.3 |
| Example 6 | 10 | — | 1858 | 639 | 29.1 | 5.9 |
| | 15 | — | 2075 | 703 | 32.8 | 8.0 |
| | 30 | — | 2948 | 1255 | 45.1 | 18.1 |
| Example 7 | 15 | 10.2 | 2457 | 1203 | 53.0 | 19.3 |
| | 30 | 9.0 | 3819 | 1813 | 37.6 | 30.5 |
| N720 [1] | 10 | — | 1184 | 578 | 16.2 | 9.0 |
| | 15 | — | 1351 | 785 | 25.5 | 15.3 |
| | 30 | — | 2828 | 1408 | 44.0 | 31.3 |
| N720-F [2] | 15 | 10.8 | 761 | 456 | 36.8 | 13.1 |
| | 30 | 13.5 | 1458 | 860 | 45.4 | 17.6 |
| N720-H [3] | 10 | 9.6 | 556 | 397 | 17.2 | 8.7 |
| | 15 | 9.8 | 701 | 560 | 23.3 | 12.8 |
| | 30 | 12.1 | 2456 | 1101 | 45.9 | 31.8 |
| VPW101x3 [4] | 15 | 6.2 | 3333 | 20 | 35.4 | 1.5 |
| | 30 | 2.2 | 3993 | 40 | 47.2 | 1.5 |

[1] 2 denier × 6 mm polyester sheath core fiber (Kuraray) with 110° C. sheath melt point
[2] 0.9 denier × 6 mm polyester sheath core fiber (Kuraray) with 110° C. sheath melt point
[3] 2 denier × 6 mm polyester sheath core fiber (Kuraray) with 130° C. sheath melt point
[4] 3 denier × 3 mm PVA fiber (Kuraray Co. Ltd.)

TABLE 2

| Binder Fiber | | Permeability | Tensile (gF) | | Burst (psi) | |
|---|---|---|---|---|---|---|
| Type | wt % | $ft^3/ft/min$ | dry | wet | dry | wet |
| Example 6 | 10 | 45.1 | 843.1 | 203.6 | 9.7 | 31.0 |
| | 15 | 41.7 | 1022.2 | 328.0 | 10.6 | 35.0 |
| | 30 | 28.9 | 1776.9 | 702.8 | 28.5 | 61.0 |

TABLE 3

| Binder Fiber | | Permeability | Air Resistance | | Tensile (gF) | | Burst (psi) | |
|---|---|---|---|---|---|---|---|---|
| Type | wt % | ft3/ft/min | (mm H2O) | Gamma [4] | dry | wet | dry | wet |
| Example 4 | 10 | 3.5 | 44.1 | 27.2 | 184 | 71 | 22.0 | 12.0 |
| | 15 | 3.5 | — | — | 263 | 109 | 19.0 | 10.0 |
| | 30 | 4.0 | — | — | 500 | 233 | 16.0 | 12.0 |
| Example 5 | 10 | 3.6 | 41.0 | 29.3 | 127 | 60 | 26.0 | 10.0 |
| | 15 | 4.0 | — | — | 139 | 69 | 26.0 | 13.0 |
| | 30 | 4.7 | — | — | 242 | 172 | 23.0 | 16.0 |
| Example 6 | 10 | 4.2 | — | — | 193 | 72 | — | — |
| | 15 | 4.1 | — | — | 228 | 118 | — | — |
| | 30 | 4.7 | — | — | 339 | 236 | — | — |
| Example 7 | 10 | 3.6 | 41.6 | 28.8 | 241 | 62 | — | — |
| | 15 | 4.0 | — | — | 323 | 70 | — | — |
| | 30 | 4.1 | — | — | 395 | 210 | — | — |
| Example 8 | 10 | 3.3 | — | — | 184 | 57 | — | — |
| | 15 | 3.3 | — | — | 261 | 96 | — | — |
| | 30 | 3.7 | — | — | 383 | 175 | — | — |
| N720-F [1] | 10 | 3.4 | 44.5 | 26.9 | 357 | 217 | — | — |
| | 15 | 3.2 | — | — | 500 | 286 | — | — |
| | 30 | 3.7 | — | — | 663 | 283 | — | — |
| 0.5 dt × 6 mm [2] | 10 | 3.4 | 41.8 | 10.8 | 274 | 38 | — | — |
| | 15 | 3.4 | — | — | 337 | 140 | — | — |
| VPW101x3 [3] | 10 | 0.5 | 137.9 | 0.5 | 707 | 2 | — | — |
| SBR latex | 10 | — | 50.9 | 9.2 | 405 | 24 | — | — |

[1] 0.9 denier × 6 mm polyester sheath core fiber (Kuraray) with 110 C. sheath melt point
[2] 0.5 dtex × 6 mm polyester sheath core fiber (Teijin) with 154 C. sheath melt point
[2] 3 denier × 3 mm PVA fiber (Kuraray)
[4] defined as $-\log_{10}(P/100)/\Delta P$ where P = penetration and Δ P is air i resistance

TABLE 4

| Binder Fiber | | Permeability | Tensile (gF) | | Burst (psi) | |
|---|---|---|---|---|---|---|
| Type | wt % | ft3/ft/min | dry | wet | dry | wet |
| Albacel (control) | 0 | 5.4 | 5690 | 0 | 30.2 | 0.0 |
| Example 6 | 10 | 2.7 | 5176 | 213 | 32.2 | 3.0 |
| | 15 | 2.4 | 5375 | 311 | 31.9 | 4.6 |
| | 30 | 2.9 | 5317 | 656 | 30.2 | 9.0 |
| 0.5 dt × 6 mm [1] | 10 | 6.7 | 4429 | 128 | 22.3 | — |
| | 15 | 8.1 | 3993 | 159 | 20.1 | 2.1 |
| | 30 | 16.0 | 2877 | 169 | 14.3 | 2.3 |
| VPW101x3 [2] | 10 | 2.7 | 7415 | 2 | 31.7 | 0.0 |
| | 15 | 4.4 | 6828 | 2 | 32.4 | — |
| SBR Latex [3] | 10 | 6.9 | 6837 | 231 | 42.8 | 1.7 |
| | 15 | 8.6 | 6821 | 427 | 43.5 | 3.0 |

[1] 0.5 dtex × 6 mm polyester sheath core fiber (Teijin) with 154 C. sheath melt point
[2] 3 denier × 3 mm PVA fiber (Kuraray)
[3] SBR Latex

Example 15

Following the general procedures outlined in Example 2, 2.5 micron diameter, 1.5 mm long synthetic polymer microfibers composed of a copolyester of residues of trans-1,4-cyclohexanedicarboxylic acid and 1,4 butanediol were prepared.

Example 16

Following the general procedures outlined in Example 2, 3.3 micron diameter, 1.5 mm long synthetic polymer microfibers composed of a Sunoco CP360H polypropylene were prepared.

Example 17

Following the general procedures outlined in Example 2, 3.3 micron diameter, 1.5 mm long synthetic polymer microfibers composed of a compounded blend of 95 wt % Braskem CP360H polypropylene and 5 wt % Clariant Licocene® 6252 maleated polypropylene were prepared.

Example 18

Following the general procedure outlined in Example 9 with a modification of drying temperature/time being 150° C. for 5 minutes and bonding temperature/time being 175° C. for 3 minutes (unless otherwise noted), synthetic binder microfibers selected from those previously described were blended at 10 wt % with 0.6 micron diameter glass microfibers (80 wt %) and 7.5 micron diameter, 6 mm chopped glass fibers (10 wt %) to yield approximately 65 gram per square meter handsheets. Example 2 was also included as a PET microfiber control which, while similar in size to the binder microfibers, will not soften and bind at the temperatures used. The characteristics of the binder fiber-containing handsheets are described below in Table 5.

Example 19

Following the general procedure outlined in Example 9 with a modification of drying temperature/time being 150° C. for 5 minutes and bonding temperature/time being 175° C. for 3 minutes (unless otherwise noted), synthetic binder microfibers selected from those previously described were blended at 50 wt % with 7.5 micron diameter, 6 mm chopped glass fibers to yield approximately 65 gram per square meter handsheets. The characteristics of the binder fiber-containing handsheets are described below in Table 6.

Example 20

Following the general procedure outlined in Example 9, the PET (i.e. non-binder) microfiber of Example 2 (10 wt %), 0.6 micron diameter glass microfibers (80 wt %), and 7.5 micron diameter, 6 mm chopped glass fibers were blended to yield approximately 65 gram per square meter handsheets. Separate sheets were bonded with an SBR latex at a binder add-on of approximately 5 and 10 wt %, respectively. The relative strength and permeability characteristics of these latex bonded sheets are compared in Table 7 to the binder microfiber bonded sheets of the present invention which are described in Example 18.

TABLE 5

| Binder Fiber | Air Resistance | | Tensile (gF) | | Burst (psi) | |
|---|---|---|---|---|---|---|
| Type | (mm H2O) | Gamma [2] | dry | wet | dry | wet |
| Example 2 (PET control) | 43.7 | 23.4 | 159 | 17 | 0 | 0 |
| Example 6 | 41.1 | 25.0 | 185 | 35 | 0 | 0 |
| Example 15 | 43.3 | 32.4 | 857 | 126 | 6.7 | 2.5 |
| Example 16 | 42.9 | 35.1 | 744 | 102 | 3.7 | 3.1 |
| Example 17 | 42.0 | 39.1 | 788 | 129 | 4.7 | 3.4 |
| N720-F [1] | 43.3 | 24.0 | 236 | 13 | 0 | 0 |

[1] 0.9 denier × 6 mm polyester sheath core fiber (Kuraray) with 110° C. sheath melt point dried at 110° C. for 5 minutes and bonded at 120° C. for five minutes.
[2] defined as $-\log_{10}(P/100)/\Delta P$ where P = penetration and Δ P is ai resistance

TABLE 6

| Binder Fiber | Tensile (gF) | | Burst (psi) | |
|---|---|---|---|---|
| Type | dry | wet | dry | wet |
| Example 15 | 4746 | 917 | 23.4 | 9.3 |
| Example 16 | 1460 | 767 | 10.8 | 3.5 |
| Example 17 | 3761 | 1640 | 25 | 14 |
| N720-F[1] | 2000 | 1681 | 33 | 24 |
| EVA S/C[2] | 417 | 402 | 6.2 | 0 |
| HDPE S/C[3] | 476 | 393 | — | 5.7 |

[1] 0.9 denier × 6 mm polyester sheath core fiber (Kuraray) with 110 C. sheath melt point dried at 110° C. for five minutes and bonded at 120° C. for five minutes.
[2] 2.0 denier × 5 mm polypropylene core/EVA sheath fiber from MiniFibers, Johnson City, TN dried at 110° C. for five minutes and bonded at 120° C. for five minutes.
[3] 2.0 denier × 5 mm polypropylene core/HDPE sheath fiber from MiniFibers, Johnson City, TN dried at 140° C. for five minutes and bonded at 140° C. for five minutes.

TABLE 7

| Binder Fiber | Air Resistance | | Tensile (gF) | | Burst (psi) | |
|---|---|---|---|---|---|---|
| Type | (mm H2O) | Gamma [1] | dry | wet | dry | wet |
| Example 2 (PET - no binder) | 43.7 | 23.4 | 159 | 17 | 0 | 0 |
| Example 2 (PET - 5% SBR) | 48.2 | 32.2 | 1268 | 46 | 6.4 | 0 |
| Example 2 (PET - 10% SBR | 52.6 | 12.2 | 1644 | 104 | 8.4 | 0 |
| Example 15 | 43.3 | 32.4 | 857 | 126 | 6.7 | 2.5 |
| Example 16 | 42.9 | 35.1 | 744 | 102 | 3.7 | 3.1 |
| Example 17 | 42.0 | 39.1 | 788 | 129 | 4.7 | 3.4 |

[1] defined as $-\log_{10}(P/100)/\Delta P$ where P = penetration and air is air resistance

What is claimed is:

1. A process of making a paper or nonwoven article comprising a wet-laid nonwoven web layer, said process comprising:

a) providing a fiber furnish comprising a plurality of fibers and a plurality of binder microfibers, wherein said binder microfibers comprise a water non-dispersible, synthetic polymer; wherein said binder microfibers have a length of less than 25 millimeters and a fineness of less than 0.5 d/f; wherein said binder microfibers have a melting temperature that is less than the melting temperature of said fibers; wherein there is an absence of a binder other than said binder microfibers; and wherein the amount of said binder microfibers range from about 5 weight percent to about 90 weight percent of said nonwoven web layer;

b) routing said fiber furnish to a wet-laid nonwoven process to produce at least one wet-laid nonwoven web layer;

c) removing water from said wet-laid nonwoven web layer; and d) thermally bonding said wet-laid nonwoven web layer after step (c); wherein said thermal bonding is conducted at a temperature such that the surfaces of said binder microfibers at least partially melt without causing said fibers to melt thereby bonding said binder microfibers to said fibers to produce said paper or nonwoven article.

2. The process of making a paper or nonwoven article according to claim 1 wherein said binder microfibers are produced by a process comprising:

(a) spinning at least one water dispersible sulfopolyester and one or more water non-dispersible synthetic polymers immiscible with the sulfopolyester into multicomponent fibers, wherein said multicomponent fibers have a plurality of domains comprising said water non-dispersible synthetic polymers whereby the domains are substantially isolated from each other by the sulfopolyester intervening between the domains; wherein said multicomponent fibers have an as-spun denier of less than about 15 denier per filament; wherein said water dispersible sulfopolyester exhibits a melt viscosity of less than about 12,000 poise measured at 240° C. at a strain rate of 1 rad/sec; and wherein said sulfopolyester comprises less than about 25 mole percent of residues of at least one sulfomonomer, based on the total moles of diacid or diol residues;

(b) cutting said multicomponent fibers of step a) to a length of less than 25 millimeters to produce cut multicomponent fibers; and (c) contacting said cut multicomponent fibers with water to remove the sulfopolyester thereby forming a wet lap of binder microfibers comprising said water non-dispersible synthetic polymer.

3. The process of making a paper or nonwoven article according to claim 1 further comprising applying at least one coating to said nonwoven web layer.

4. The process of making a paper or nonwoven article according to claim 1 wherein said thermal bonding is accomplished by through-air heating or calendaring.

5. The process of making a paper or nonwoven article according to claim 1 wherein said wet-laid nonwoven process comprises routing a paperforming slurry to continuous screens.

6. The process of making a paper or nonwoven article according to claim 1 wherein said wet-laid nonwoven process comprises:

(a) optionally, rinsing said binder microfibers with water;

(b) adding water to said binder microfibers to produce a microfiber slurry;

(c) adding said fibers and optionally, additives to said microfiber slurry to produce said fiber furnish; and (d) transferring said fiber furnish to said wet-laid nonwoven process to produce the nonwoven web layer.

7. The process of making a paper or nonwoven article according to claim 1 wherein said wet-laid nonwoven process comprises at least one screen, mesh, or sieve in order to remove the water from said fiber furnish.

8. The process of making a paper or nonwoven article according to claim 1 wherein said wet-laid nonwoven process comprises a Fourdrinier or inclined wire process.

9. The process of making a paper or nonwoven article according to claim 1 wherein said binder microfibers have a length of less than 10 millimeters.

10. The process of making a paper or nonwoven article according to claim 1 wherein said water non-dispersible, synthetic polymer is selected from the group consisting of polyolefins, polyesters, copolyesters, polyamides, polylactides, polycaprolactone, polycarbonate, polyurethane, acrylics, cellulose ester, and/or polyvinyl chloride.

11. The process of making a paper or nonwoven article according to claim 10 wherein said polyesters are at least one selected from the group consisting of polyethylene terephthalate homopolymer, polyethylene terephthalate copolymer, polybutylene terephthalate, polycyclohexylene cyclohexanedicarboxylate, polycyclohexylene terephthalate, and polytrimethylene terephthalate.

12. The process of making a paper or nonwoven article according to claim 1 wherein said fibers are at least one selected the group consisting of glass, cellulosic, and synthetic polymers.

13. The process of making a paper or nonwoven article according to claim 1 wherein said fibers are at least one selected from the group consisting of cellulosic fiber pulp, inorganic fibers, polyester fibers, nylon fibers, polyolefin fibers, rayon fibers, lyocell fibers, acrylic fibers, cellulose ester fibers, post consumer recycled fibers, and combinations thereof.

14. The process of making a paper or nonwoven article according to claim 1 wherein said nonwoven web layer comprises fibers in an amount of at least about 10 weight percent of the nonwoven web layer.

15. The process of making a paper or nonwoven article according to claim 1 further comprising adding at least one additive to said nonwoven web layer; and wherein said additive is selected from the group consisting of starches, fillers, light and heat stabilizers, antistatic agents, extrusion aids, dyes, anticounterfeiting markers, slip agents, tougheners, adhesion promoters, oxidative stabilizers, UV absorbers, colorants, pigments, opacifiers (delustrants), optical brighteners, fillers, nucleating agents, plasticizers, viscosity modifiers, surface modifiers, antimicrobials, antifoams, lubricants, thermostabilizers, emulsifiers, disinfectants, cold flow inhibitors, branching agents, oils, waxes, and catalysts.

16. The process of making a paper or nonwoven article according to claim 1 wherein said binder fibers have a cross-section that is essentially round or essentially wedge-shaped.

17. The process of making a paper or nonwoven article according to claim 1 wherein said binder fibers are ribbon fibers having a transverse aspect ratio of at least 2:1.

* * * * *